US008387863B2

(12) United States Patent
Mizushima

(10) Patent No.: US 8,387,863 B2
(45) Date of Patent: Mar. 5, 2013

(54) MONEY DEPOSITING AND DISPENSING MACHINE

(75) Inventor: Yoshikatsu Mizushima, Hyogo (JP)

(73) Assignee: Glory Ltd., Himeji-Shi, Hyogo (JP)

( * ) Notice: Subject to any disclaimer, the term of this patent is extended or adjusted under 35 U.S.C. 154(b) by 286 days.

(21) Appl. No.: 12/734,758

(22) PCT Filed: Nov. 28, 2007

(86) PCT No.: PCT/JP2007/072913

§ 371 (c)(1),
(2), (4) Date: May 19, 2010

(87) PCT Pub. No.: WO2009/069200

PCT Pub. Date: Jun. 4, 2009

(65) Prior Publication Data

US 2010/0274382 A1 Oct. 28, 2010

(51) Int. Cl.
*G07F 19/00* (2006.01)

(52) U.S. Cl. ..... 235/379; 235/375

(58) Field of Classification Search ..... 235/379, 235/375

See application file for complete search history.

(56) References Cited

U.S. PATENT DOCUMENTS 6,726,097 B2 * 4/2004 Graef et al. ..... 235/379

FOREIGN PATENT DOCUMENTS

| | | |
|---|---|---|
| JP | 07-82570 | 6/1995 |
| JP | 2006-120180 | 5/2006 |
| JP | 2006-350818 | 12/2006 |

* cited by examiner

*Primary Examiner* — Karl D Frech

(74) *Attorney, Agent, or Firm* — Renner, Kenner, Greive, Bobak, Taylor & Weber

(57) ABSTRACT

The present invention provides a money depositing and dispensing machine 11 which suppresses reduction in money stored in denomination-specific storing and ejecting units 53 to be dispensed and prevents suspension of transactions due to a shortage of money to be dispensed even when unfit money is recognized in a dispensing process.

In a dispensing process, normal money is transported to an outlet 16, and money recognized as unfit money is judged whether it is allowed to be dispensed to the outlet 16 based on the kind of unfit money. Stained money of unfit money is allowed to be dispensed to the outlet 16, and unfit money other than stained money is disallowed to be dispensed to the outlet 16. Stained money is not rejected but is handled as money to be dispensed, and accordingly, reduction in money stored in the denomination-specific storing and ejecting units 53 to be dispensed is suppressed, and suspension of transactions due to a shortage of money to be dispensed is prevented.

14 Claims, 10 Drawing Sheets

| STORING DESTINATION | STORING DESTINATION SETTING PATTERN 1 | STORING DESTINATION SETTING PATTERN 2 | STORING DESTINATION SETTING PATTERN 3 | STORING DESTINATION SETTING PATTERN 4 |
|---|---|---|---|---|
| REJECT BOX 52 | ABNORMAL BANKNOTES | ABNORMAL BANKNOTES SMALL DENOMINATION UNFIT NOTES | ABNORMAL BANKNOTES | ABNORMAL BANKNOTES UNFIT NOTES (OF ALL DENOMINATIONS) |
| DENOMINATION-SPECIFIC STORING AND EJECTING UNIT 53a | 5 EURO | 5 EURO | 5 EURO | 5 EURO |
| DENOMINATION-SPECIFIC STORING AND EJECTING UNIT 53b | 10 EURO | 10 EURO | 10 EURO | 10 EURO |
| DENOMINATION-SPECIFIC STORING AND EJECTING UNIT 53c | 20 EURO | 20 EURO | 20 EURO | 20 EURO |
| DENOMINATION-SPECIFIC STORING AND EJECTING UNIT 53d | 50 EURO | 50 EURO | 50 EURO | 50 EURO |
| DENOMINATION-SPECIFIC STORING AND EJECTING UNIT 53e | UNFIT NOTES (OF ALL DENOMINATIONS) | 100 EURO | 100 EURO | 100 EURO |
| DENOMINATION-SPECIFIC STORING AND EJECTING UNIT 53f | 100, 200, 500 EURO | 200, 500 EURO LARGE DENOMINATION UNFIT NOTES (200, 500 EURO) | 200, 500 EURO UNFIT NOTES (OF ALL DENOMINATIONS) | 200, 500 EURO |

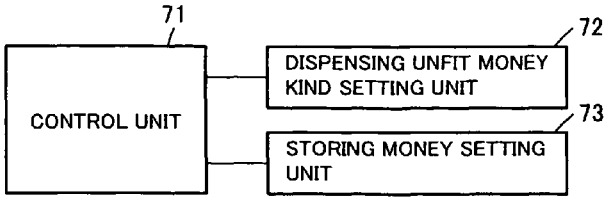

FIG. 3

| STORING DESTINATION | STORING DESTINATION SETTING PATTERN 1 | STORING DESTINATION SETTING PATTERN 2 | STORING DESTINATION SETTING PATTERN 3 | STORING DESTINATION SETTING PATTERN 4 |
|---|---|---|---|---|
| REJECT BOX 52 | ABNORMAL BANKNOTES | ABNORMAL BANKNOTES SMALL DENOMINATION UNFIT NOTES | ABNORMAL BANKNOTES | ABNORMAL BANKNOTES UNFIT NOTES (OF ALL DENOMINATIONS) |
| DENOMINATION-SPECIFIC STORING AND EJECTING UNIT 53a | 5 EURO | 5 EURO | 5 EURO | 5 EURO |
| DENOMINATION-SPECIFIC STORING AND EJECTING UNIT 53b | 10 EURO | 10 EURO | 10 EURO | 10 EURO |
| DENOMINATION-SPECIFIC STORING AND EJECTING UNIT 53c | 20 EURO | 20 EURO | 20 EURO | 20 EURO |
| DENOMINATION-SPECIFIC STORING AND EJECTING UNIT 53d | 50 EURO | 50 EURO | 50 EURO | 50 EURO |
| DENOMINATION-SPECIFIC STORING AND EJECTING UNIT 53e | UNFIT NOTES (OF ALL DENOMINATIONS) | 100 EURO | 100 EURO | 100 EURO |
| DENOMINATION-SPECIFIC STORING AND EJECTING UNIT 53f | 100, 200, 500 EURO | 200, 500 EURO LARGE DENOMINATION UNFIT NOTES (200, 500 EURO) | 200, 500 EURO UNFIT NOTES (OF ALL DENOMINATIONS) | 200, 500 EURO |

FIG. 4

MONEY DEPOSITING AND DISPENSING MACHINE

TECHNICAL FIELD

The present invention relates to a money depositing and dispensing machine which performs money depositing and dispensing processes.

BACKGROUND ART

Conventionally, in a money depositing and dispensing machine to be used at counters of financial institutions, etc., unfit money included in deposited money recognized in a depositing process is received into the machine (allowed to be deposited), however, unfit money included in money to be dispensed recognized in a dispensing process is not used as money to be dispensed, but is to be stored in an unfit money storing unit or a rejected money storing unit which stores unrecognizable money (refer to, for example, Patent Document 1). Such unfit money includes stained money (stained in the case of a banknote), thickened money (folded in the case of a banknote), deformed money (torn in the case of a banknote), and fatigued money (wornout in the case of a banknote), etc.

Denomination-specific storing and ejecting units, which are generally used in a money depositing and dispensing machine for recycling deposited money as money to be dispensed, and which store, by denomination, the deposited money to be recycled as money to be dispensed, have a large capacity for storing a large volume of notes and coins, however, an unfit money storing unit and a rejected money storing unit are comparatively small. This is because, when money is recognized as normal money in a depositing process and the money stored in corresponding denomination-specific storing and ejecting units is recycled and re-recognized in a dispensing process, the money is unlikely to be recognized as money (unfit money or unrecognizable money (rejected money)) other than normal money.

Patent Document 1: Japanese Patent Publication No. 7-82570 (pp. 4-5, FIG. 1)

DISCLOSURE OF THE INVENTION

Problem to be Solved by the Invention

However, in some places, circulated money is poor in quality, and in a money depositing and dispensing machine used in such a place, when money to be dispensed is re-recognized in a dispensing process, there is a possibility that money is frequently recognized as unfit money, and in this case, the unfit money is stored in the unfit money storing unit or rejected money storing unit, and money for replacement is taken out from the denomination-specific storing and ejecting unit, and thus the recycled money to be used as money to be dispensed in the denomination-specific storing and ejecting unit is reduced, causing a shortage of money to be dispensed, and the transaction is inevitably suspended.

Further, the unfit money storing unit and rejected money storing unit frequently become full, and this requires a bank clerk to manually remove money from the unfit money storing unit and the rejected money storing unit, so that the burden on bank clerks increases.

In German banks, to remove money from a money depositing and dispensing machine, customers are made to exit from banks for security reasons, and the action of removing money from the unfit money storing unit and rejected money storing unit is inconvenient for both bank clerks and customers.

The present invention was made in view of these circumstances, and an object thereof is to provide a money depositing and dispensing machine which suppresses reduction in money to be dispensed in denomination-specific storing and ejecting units and prevents suspension of transactions due to a shortage of money to be dispensed even when unfit money is recognized in a dispensing process.

Means to Solve the Problems

A money depositing and dispensing machine of the present invention which performs money depositing and dispensing processes, includes: an inlet for receiving money to be deposited; an outlet for ejecting money to be dispensed; a recognition unit which recognizes a denomination and fitness of money and a kind of unfit money; a plurality of denomination-specific storing and ejecting units which store money by denomination according to a result of recognition by the recognition unit and are capable of ejecting stored money to be transported to the outlet in a dispensing process; and a control unit which transports money recognized as normal money by the recognition unit to the outlet, and judges whether money recognized as unfit money is allowed to be dispensed to the outlet in a dispensing process, based on the kind of unfit money.

The money depositing and dispensing machine according to another aspect of the present invention includes: a dispensing unfit money kind setting unit capable of setting a kind of unfit money which is allowed to be dispensed to the outlet.

The money depositing and dispensing machine according to another aspect of the present invention includes: a plurality of recognition units.

The money depositing and dispensing machine according to another aspect of the present invention includes: a rejected money storing unit which stores money not recognized as normal money by the recognition unit, and in a dispensing process, among money recognized as unfit money by the recognition unit, according to the kind set by the dispensing unfit money kind setting unit, the control unit determines to transport money set as allowed to be dispensed to the outlet, and determines to transport money set as disallowed, to be dispensed to the rejected money storing unit.

The money depositing and dispensing machine according to another aspect of the present invention includes: a rejected money storing unit which stores money not recognized as normal money by the recognition unit, and in a dispensing process, among money recognized as unfit money by the recognition unit, according to the kind set by the depositing unfit money kind setting unit, the control unit determines to transport stained money to the outlet, and determines to transport unfit money other than stained money to the rejected money storing unit.

With the money depositing and dispensing machine according to another aspect of the present invention, the kind of unfit money to be recognized by the recognition unit includes, in addition to the stained money, at least any one kind of thickened money with a thickness different from that of normal money, deformed money with a size different from that of normal money, and fatigued money with a higher degree of fatigue than normal money.

The money depositing and dispensing machine according to another aspect of the present invention includes: a storing money setting unit capable of setting to store and unfit money of all denominations and one or more pieces of normal money in a mixed state for each of the plurality of denomination-specific storing and ejecting units.

The money depositing and dispensing machine according to another aspect of the present invention includes: a storing money setting unit capable of setting to store unfit money of a specific denomination and one or more pieces of normal money in a mixed state for each of the plurality of denomination-specific storing and ejecting units.

The money depositing and dispensing machine according to another aspect of the present invention includes: a storing money setting unit capable of setting to store only unfit money of all denominations for each of the plurality of denomination-specific storing and ejecting units.

The money depositing and dispensing machine according to another aspect of the present invention includes: a storing money setting unit capable of setting to store only unfit money of only a specific denomination for each of the plurality of denomination-specific storing and ejecting units.

The money depositing and dispensing machine according to another aspect of the present invention includes: an escrow unit which escrows money to be deposited, and in a depositing process, the control unit transports normal money to the escrow unit, and after a deposit is approved, re-recognizes the money in the escrow unit, and determines to transport unfit money judged as disallowed to be dispensed to the outlet according to a re-recognition result and the kind set by the dispensing unfit money kind setting unit, to the rejected money storing unit.

The money depositing and dispensing machine according to another aspect of the present invention includes: an escrow unit which escrows money to be deposited, and in a depositing process, the control unit transports normal money to the escrow unit, and after a deposit is approved, re-recognizes the money in the escrow unit, and determines to transport unfit money judged as allowed to be dispensed to the outlet according to a re-recognition result and the kind set by the dispensing unfit money kind setting unit, to the corresponding denomination-specific storing and ejecting unit based on information set by the storing money setting unit.

The money depositing and dispensing machine according to another aspect of the present invention includes: an escrow unit which escrows money to be deposited; and a rejected money storing unit which stores money not recognized as normal money by the recognition unit, and in a depositing process, the control unit transports normal money to the escrow unit, and after a deposit is approved, re-recognizes the money in the escrow unit, and determines to transport unfit money judged as disallowed to be dispensed to the outlet according to a re-recognition result and the kind set by the dispensing unfit money kind setting unit, to the rejected money storing unit, and determines to transport unfit money judged as allowed to be dispensed to the outlet to the corresponding denomination-specific storing and ejecting unit based on information set by the storing money setting unit.

The money depositing and dispensing machine according to another aspect of the present invention includes: an escrow unit which escrows money to be deposited, and in a dispensing process, when money is dispensed from the denomination-specific storing and ejecting unit storing one or more pieces of normal money and unfit money in a mixed state based on the storing money setting unit, in a case where money of a denomination unnecessary to be dispensed is ejected from the denomination-specific storing and ejecting unit, the control unit transports the money of the denomination unnecessary to be dispensed, to the escrow unit, and after a predetermined quantity of money is ejected to the outlet, transports the money of the denomination unnecessary to be dispensed which has been transported to the escrow unit, to the corresponding denomination-specific storing and ejecting unit.

Advantages of the Invention

With the money depositing and dispensing machine of the present invention, a dispensing process is performed whereby money recognized as normal money by the recognition unit is transported to the outlet, and by judging whether money recognized as unfit money is to be dispensed to the outlet according to the kind of unfit money, and by handling unfit money of a specific kind as money to be dispensed without rejecting, reduction in money to be dispensed in the denomination-specific storing and ejecting unit is suppressed, and suspension of transactions due to a shortage of money to be dispensed can be prevented.

With the depositing and dispensing machine of the present invention, one advantage is that the kind of unfit money allowed to be dispensed to the outlet can be arbitrarily set by the dispensing unfit money kind setting unit.

With the money depositing and dispensing machine of the present invention, another advantage is that the plurality of recognition units are provided, such that the recognition units can be used for a depositing process and a dispensing process respectively, for example.

With the money depositing and dispensing machine of the present invention, another advantage is that in a dispensing process, among money recognized as unfit money by the recognition unit, according to the kind set by the dispensing unfit money kind setting unit, money set as allowed to be dispensed is transported to the outlet and money set as disallowed to be dispensed is transported to the rejected money storing unit, and accordingly, only unfit money that is a set specific kind can be handled as money to be dispensed without being rejected.

With the money depositing and dispensing machine of the present invention, another advantage is that in a dispensing process, among money recognized as unfit money by the recognition unit, according to the kind set by the dispensing unfit money kind setting unit, stained money more stained than normal money is transported to the outlet, and unfit money other than stained money is transported to the rejected money storing unit, and accordingly, only stained money can be handled as money to be dispensed without being rejected.

According to the money depositing and dispensing machine of the present invention, another advantage is that the kind of unfit money other than stained money includes at least any one kind of thickened money with a thickness different from that of normal money, deformed money with a size different from that of normal money, and fatigued money with a higher degree of fatigue than that of normal money, and unfit money other than stained money can be transported to the rejected money storing unit.

According to the money depositing and dispensing machine of the present invention, another advantage is that storing unfit money of all denominations and one or more pieces of normal money in a mixed state can be set by the storing money setting unit for each of the plurality of denomination-specific storing and ejecting units, and a large volume of unfit money can be stored in a state where normal money can be stored in the plurality of denomination-specific storing and ejecting units.

With the money depositing and dispensing machine of the present invention, another advantage is that storing unfit money of a specific denomination and one or more pieces of normal money in a mixed state can be set by the storing money setting unit for each of the plurality of denomination-specific storing and ejecting units, and a large volume of unfit money can be stored in a state where normal money can be stored in the plurality of denomination-specific storing and ejecting units.

With the money depositing and dispensing machine of the present invention, another advantage is that storing of only unfit money of all denominations can be set by the storing money setting unit for each of the plurality of denomination-specific storing and ejecting units, and a large volume of unfit money can be stored by using the denomination-specific storing and ejecting units.

With the money depositing and dispensing machine of the present invention, another advantage is that storing of only unfit money of only a specific denomination can be set by storing money setting unit for each of the plurality of denomination-specific storing and ejecting units, and a large volume of unfit money of the specific denomination can be stored by using the denomination-specific storing and ejecting units.

With the money depositing and dispensing machine of the present invention, another advantage is that in a depositing process, normal money is transported to the escrow unit, and after a deposit is approved, the money in the escrow unit is re-recognized, and unfit money judged as disallowed to be dispensed to the outlet according to a re-recognition result and the kind set by the dispensing unfit money kind setting unit is transported to the rejected money storing unit, and accordingly, occurrence of unfit money to be judged as disallowed to be dispensed to the outlet in a dispensing process can be reduced.

With the money depositing and dispensing machine of the present invention, another advantage is that in a depositing process, normal money is transported to the escrow unit, and after a deposit is approved, money in the escrow unit is re-recognized, and unfit money judged as allowed to be dispensed to the outlet according to a re-recognition result and the kind set by the dispensing unfit money kind setting unit is transported to the corresponding denomination-specific storing and ejecting unit based on information set by the storing money setting unit, and accordingly, the unfit money can be handled as normal money.

With the money depositing and dispensing machine of the present invention, another advantage is that in a depositing process, normal money is transported to the escrow unit, and after a deposit is approved, money in the escrow unit is re-recognized, and unfit money judged as disallowed to be dispensed to the outlet according to a re-recognition result and the kind set by the dispensing unfit money kind setting unit is transported to the rejected money storing unit, and accordingly, the unfit money can be separated from the normal money, and unfit money judged as allowed to be dispensed to the outlet is transported to the corresponding denomination-specific storing and ejecting unit based on information set by the storing money setting unit, and can be accordingly handled as normal money.

With the money depositing and dispensing machine of the present invention, another advantage is that in a dispensing process, when money is dispensed from the denomination-specific storing and ejecting unit storing one or more pieces of normal money and unfit money in a mixed state based on the storing money setting unit, in a case where money of a denomination unnecessary to be dispensed is ejected from the denomination-specific storing and ejecting unit, the money of the denomination unnecessary to be dispensed is transported to the escrow unit, and after a predetermined quantity of money is ejected to the outlet, the money of the denomination unnecessary to be dispensed which has been transported to the escrow unit is transported to the corresponding denomination-specific storing and ejecting unit, and accordingly, only money necessary to be dispensed can be selectively dispensed.

BRIEF DESCRIPTION OF THE DRAWINGS

FIG. 3 is a block diagram of a control unit of the same banknote depositing and dispensing machine;

FIG. 4 is a table showing setting patterns of money to be stored in a rejected money storing unit and denomination-specific storing and ejecting units of the same banknote depositing and dispensing machine;

REFERENCE NUMERALS

Figure 1:
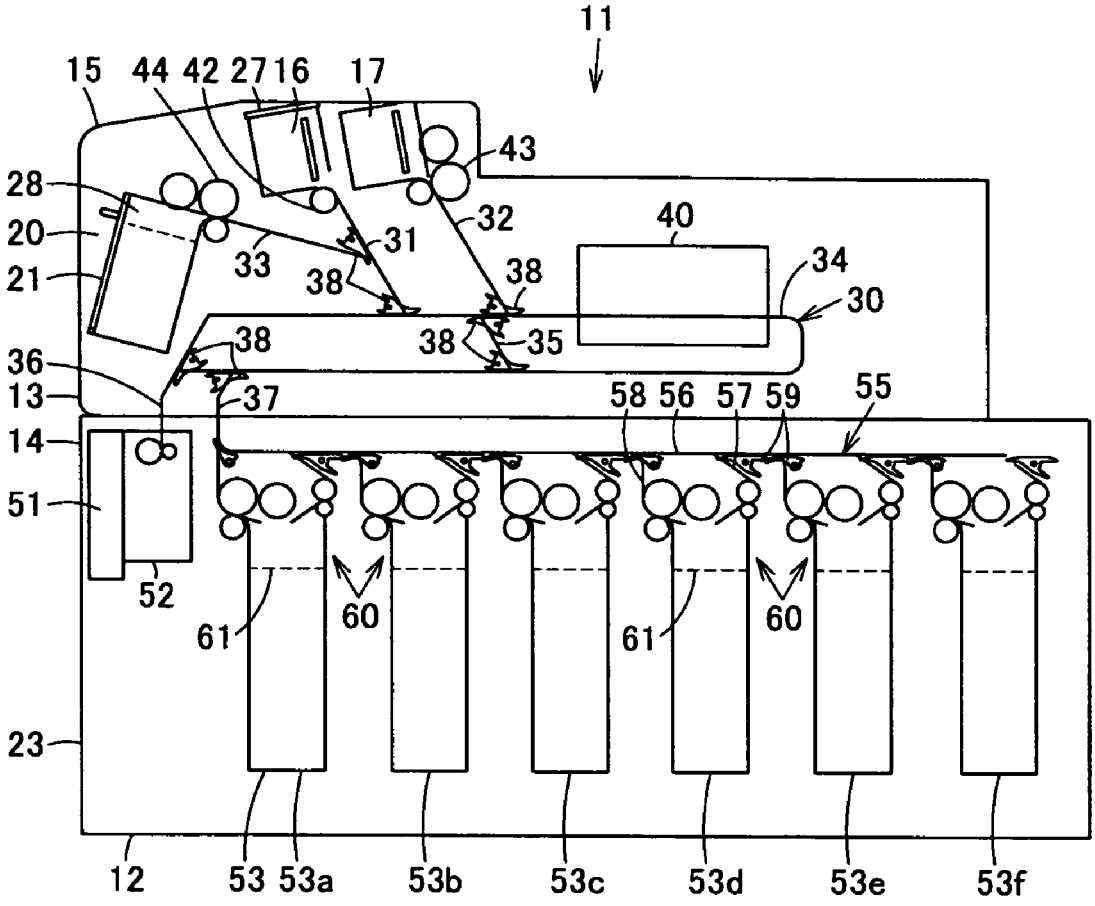
FIG. 1 is a schematic sectional view from a lateral side of a banknote depositing and dispensing machine showing a first embodiment of a money depositing and dispensing machine of the present invention.

11 Banknote depositing and dispensing machine as money depositing and dispensing machine
16 Outlet
17 Inlet
28 Escrow unit
40 Recognition unit
52 Reject box as rejected money storing unit
53 Denomination-specific storing and ejecting unit
71 Control unit

72 Dispensing unfit money kind setting unit
73 Storing money setting unit
101 Coin depositing and dispensing machine as money depositing and dispensing machine
109 Denomination-specific storing and ejecting unit
121 Recognition unit
201 Coin depositing and dispensing machine as money depositing and dispensing machine
203 Inlet
204 Outlet
209 Recognition unit

BEST MODE FOR CARRYING OUT THE INVENTION

Hereinafter, embodiments of the present invention will be described with reference to the drawings.

A first embodiment is shown in FIG. 1 to FIG. 9.

Figure 2:
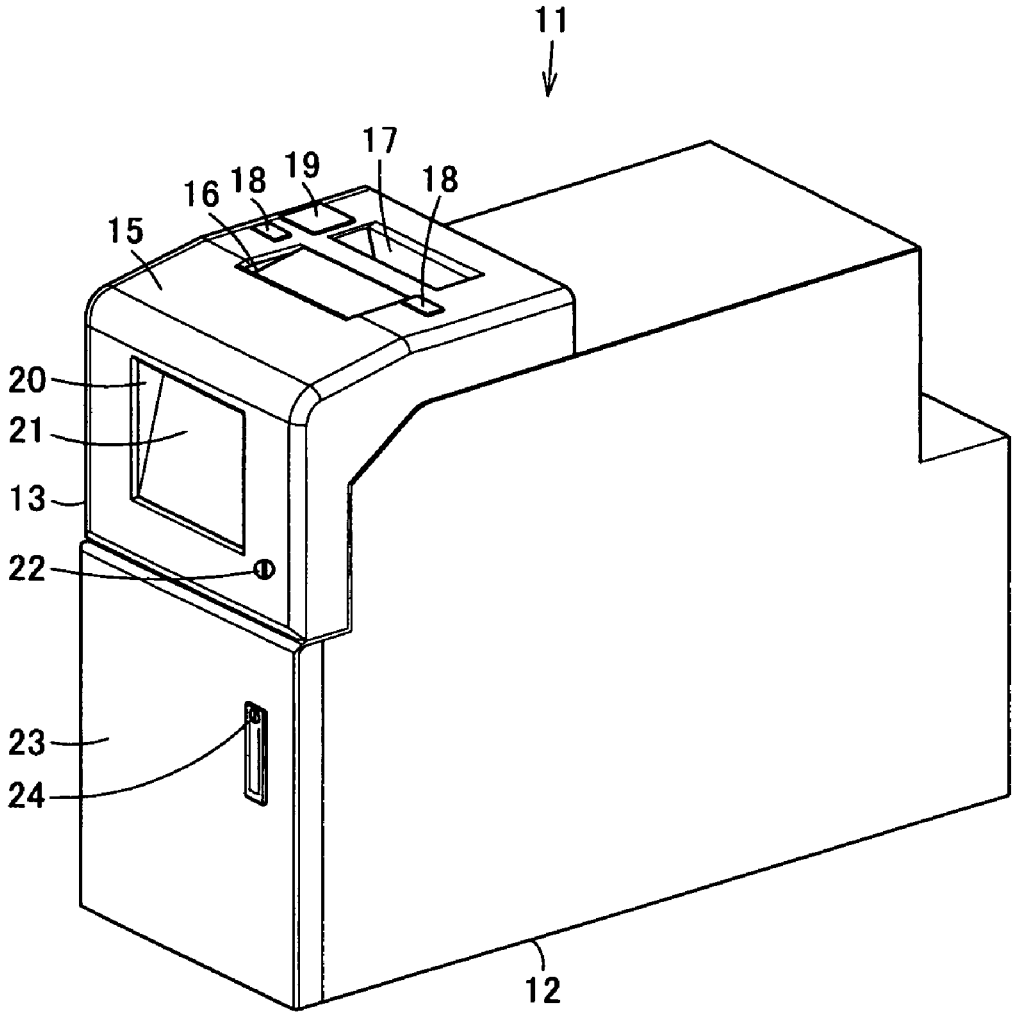
FIG. 2 is a perspective view of the same banknote depositing and dispensing machine.

FIG. 1 and FIG. 2 show a banknote depositing and dispensing machine 11 as a money depositing and dispensing machine, which handles banknotes as money. This banknote depositing and dispensing machine 11 is installed between two tellers inside a counter of a financial institution such as a bank, and can be used by the teller on either the left or right of the banknote depositing and dispensing machine 11 or both of the tellers. To the banknote depositing and dispensing machine 11, terminals not shown which are operated by the two left and right tellers are connected, and the banknote depositing and dispensing machine 11 can be operated by these terminals.

The banknote depositing and dispensing machine 11 includes a machine body 12, and when the front face is set on the side of the operation surface to be operated by the tellers and the rear face is set on the side opposite to the front face, that is, the customer side outside the counter, the machine body is configured into a vertical shape having a narrow lateral width in the left-right direction, a long depth in the front-rear direction, and a raised height in the vertical direction.

The machine body 12 is provided with an upper unit 13 and a lower unit 14 which are capable of being drawn out from the front face side of the machine body 12.

An operation unit 15 is provided on the front side of the upper unit 13, and on the upper surface of the operation unit 15, in order from the front side, an outlet 16 for dispensing banknotes and an inlet 17 for depositing banknotes are formed. In both left and right areas of the area of the outlet 16 and the inlet 17, occupancy buttons 18 for instructing which of the left and right tellers occupies a depositing or dispensing process are disposed, and on one side of the area of the outlet 16 and the inlet 17, a display unit 19 which displays a jam point and a banknote remaining quantity is disposed.

On the front face of the operation unit 15, a return port 20 is formed for taking-out banknotes which are returned in response to disapproval of a deposit after escrow of banknotes to be deposited in a depositing process, and is closed by a return port door 21 in an openable and closable manner. An upper unit lock 22 to be operated by a teller, which locks and unlocks the upper unit 13 in a state where the upper unit 13 is housed in the machine body 12, is provided. By unlocking the upper unit lock 22, the upper unit 13 can be drawn out from the machine body 12.

A door body 23 is attached to the lower area of the front face of the machine body 12 in an openable and closable manner, and a lower unit lock 24 which locks and unlocks the door body 23 in a state where the lower unit 14 is housed in the machine body 12 and the door body 23 is closed, and is operated exclusively by a high level manager of the financial institution or employees of a security company is provided, and by unlocking and opening the door body 23, the lower unit 14 can be drawn forward from the inside of the machine body 12. The lower unit lock 24 cannot be unlocked by tellers. The lower unit 14 may be a lock of a password input type. In this case, by providing buttons such as alphanumeric keys for inputting a password and informing a specific teller and a manager, etc., of the password, only the specific person is allowed to draw the lower unit 14.

In the outlet 16 and the inlet 17 of the upper unit 13, banknotes can be stored in an erect posture in which the short edges of the rectangular banknotes are set vertically. In the outlet 16, a transparent shutter 27 which closes the outlet 16 during dispensing and opens after dispensing is finished is disposed in an openable and closable manner, and during dispensing, banknotes dispensed to the outlet 16 are visible through the closed shutter 27.

Inside the return port 20 of the upper unit 13, an escrow unit 28 which escrows banknotes is disposed. On the front face of the escrow unit 28, a transparent return port door 21 which is locked by an electromagnetic lock not shown in a closed state is disposed in an openable and closable manner.

Inside the upper unit 13, an upper unit side transport unit 30 which is connected to the outlet 16, the inlet 17, and the escrow unit 28 and transports banknotes is disposed. This upper unit side transport unit 30 includes a dispensing transport unit 31 which transports banknotes to the outlet 16, a deposit transport unit 32 which transports banknotes fed out one by one from the inlet 17, an escrow transport unit 33 which is connected to the middle portion of the dispensing transport unit 31 and transports banknotes between the dispensing transport unit and the escrow unit 28, a recognition transport unit 34 which has a substantially U shape folded forward from the rear side and has an upper end side to which the dispensing transport unit 31 and the deposit transport unit 32 are connected, a bypass transport unit 35 which connects one end on the upper side and the other end on the lower side of the recognition transport unit 34, a reject transport unit 36 to which the one end on the upper side and the other end on the lower side of the recognition transport unit 34 are connected and which is extended to the lower unit 14, and a storing and dispensing transport unit 37 which is connected to the other end on the lower side of the recognition transport unit 34 (the lower end of the bypass transport unit 35) and extended to the lower unit 14. At least the dispensing transport unit 31, the escrow transport unit 33, the recognition transport unit 34, and the storing and dispensing transport unit 37 can reverse the banknote transporting direction. In the respective connecting portions between the transport units 31 to 37, switching members 38 for switching the banknote advancing direction are disposed. In the recognition transport unit 34, a recognition unit 40 which recognizes authenticity, denominations, and fitness of banknotes to be transported and kinds of unfit notes (unfit money) is disposed.

In the outlet 16, a feed-in mechanism 42 which feeds and stores banknotes to be dispensed which are transported by the dispensing transport unit 31 into the outlet 16 one by one is disposed. In the inlet 17, a feed-out mechanism 43 which feeds out banknotes to be deposited which are inserted in the inlet 17 to the deposit transport unit 32 one by one is disposed.

In the upper portion of the escrow unit 28, a feed-in and feed-out mechanism 44 which feeds and stores banknotes into the escrow unit 28 one by one from the escrow transport unit 33 and feeds out banknotes stored in the escrow unit 28 to the escrow transport unit 33 one by one is disposed.

As shown in FIG. 1, in the lower unit 14, in a front area of the machine body 12, a removable box 51 which stores deformed banknotes, checks, and gift certificates, etc., is removably disposed, and a reject box 52 as a rejected money storing unit which stores banknotes not recognized as normal banknotes by the recognition unit 40 is disposed. Further, in the area behind the reject box 52, a plurality of denomination-specific storing and ejecting units 53 (53*a* to 53*f*) which store banknotes by denomination are juxtaposed in the front-rear direction. The banknote storing capacity of the reject box 52 is smaller than the banknote storing capacities of the denomination-specific storing and ejecting units 53.

Inside the lower unit 14, a lower unit side transport unit 55 which is connected to the denomination-specific storing and ejecting units 53 is disposed. This lower unit side transport unit 55 includes a main transport unit 56 which is disposed in the front-rear direction along the area above the denomination-specific storing and ejecting units 53, a feed-in transport unit 57 which transports banknotes to be fed into the denomination-specific storing and ejecting units 53 from the main transport unit 56, and a feed-out transport unit 58 which transports banknotes to be fed out from the denomination-specific storing and ejecting units 53 to the main transport unit 56, and in the respective connecting portions between the transport units 56 to 58, switching members 59 which switch the banknote advancing direction are disposed. The main transport unit 56 of the lower unit side transport unit 55 can reverse the banknote transporting direction.

In the upper portion of each denomination-specific storing and ejecting unit 53, a feed-in and feed-out mechanism which feeds and stores banknotes into the denomination-specific storing and ejecting unit 53 one by one from the feed-in transport unit 57 and feeds out banknotes stored in the denomination-specific storing and ejecting unit 53 to the feed-out transport unit 58 one by one, is disposed.

Inside each denomination-specific storing and ejecting unit 53, a stacking base 61 is disposed vertically movably, and banknotes are stacked vertically on the stacking base 61. When the banknotes are fed in the denomination-specific storing and ejecting unit 53, each time a banknote is stacked and stored on the stacking base 61, the stacking base 61 is successively moved down to receive the banknote, and the height of the upper surface on which the banknotes are stacked and stored is kept constant. When banknotes are fed out from the denomination-specific storing and ejecting unit 53, the stacking base 61 is moved up and the banknotes are pressed against the feed-in and feed-out mechanism 60 and fed out one by one by the feed-in and feed-out mechanism 60.

The reject transport unit 36 of the upper unit 13 is connected to the reject box 52 of the lower unit 14, and the storing and dispensing transport unit 37 of the upper unit 13 is connected to the front end of the main transport unit 56 of the lower unit 14.

FIG. 3 shows a control unit 71 which controls the banknote depositing and dispensing machine 11.

This control unit 71 has a function of, in a dispensing process, transporting normal banknotes which are regular and not unfit notes to the outlet 16 among banknotes fed out from the denomination-specific storing and ejecting units 53 and recognized by the recognition unit 40, and judging whether banknotes recognized as regular but unfit notes are allowed to be dispensed to the outlet 16 according to the kinds of unfit notes.

In detail, a dispensing unfit money kind setting unit 72 is provided which can set a kind of unfit notes allowed to be dispensed to the outlet 16 through an operation unit such as a terminal to be operated by a teller. The settable kinds of unfit notes are stained notes (stained banknotes) more stained as compared with normal banknotes, thickened notes (folded banknotes) with thicknesses different from the thickness of normal banknotes, deformed notes (torn banknotes) with sizes different from the size of normal banknotes, and fatigued notes (wornout banknotes) with a high degree of fatigue as compared with normal banknotes, etc. In this embodiment, stained notes are set as banknotes allowed to be dispensed to the outlet 16, and unfit notes other than stained notes are set as banknotes disallowed to be dispensed to the outlet 16.

The control unit 71 has a function of, in a dispensing process, determining to transport stained notes, among banknotes recognized as unfit notes by the recognition unit 40, as banknotes set as allowed to be dispensed according to the kind set by the dispensing unfit money kind setting unit 72, to the outlet 16, and determining to transport unfit notes other than stained notes, as banknotes set as disallowed to be dispensed, to the reject box 52, and has a function of, in a depositing process, transporting normal banknotes and unfit notes to the escrow unit 28, and after a deposit is approved, re-recognizing the banknotes in the escrow unit 28, and determining to transport stained notes judged as allowed to be dispensed to the outlet 16 according to a re-recognition result and the kind set by the dispensing unfit money kind setting unit 72, to the corresponding denomination-specific storing and ejecting unit 53, and determining to transport unfit notes other than stained notes, judged as disallowed to be dispensed to the outlet 16, to the reject box 52.

Further, a storing money setting unit 73 is provided which can make any setting of storing unfit notes of all denominations and a plurality of normal banknotes in a mixed state, storing unfit notes of a specific denomination and a plurality of normal banknotes in a mixed state, storing only unfit notes of all denominations, and storing only unfit notes of only a specific denomination for each of the plurality of denomination-specific storing and ejecting units 53. Generally, the storing money setting unit 73 described here may be provided separately from a storing normal banknote setting unit (storing normal money setting unit) not shown which can arbitrarily set storing of normal banknotes of a specific denomination or a plurality of denominations for each of the denomination-specific storing and ejecting units 53, or the storing money setting unit 73 may be provided as apart of the setting unit. Here, unfit note means unfit note other than stained note, and stained notes are stored in the corresponding denomination-specific storing and ejecting units 53 similar to the normal banknotes.

As shown in FIG. 4, as settings of kinds to be stored in the reject box 52 and the denomination-specific storing and ejecting units 53*a* to 53*f*, for example, four storing destination setting patterns 1 to 4 are shown, and these storing destination setting patterns 1 to 4 can be arbitrarily set. Other storing destination setting patterns can also be arbitrarily set.

In the storing destination setting pattern 1, abnormal banknotes are stored in the reject box 52, 5 euro, 10 euro, 20 euro, and 50 euro notes are stored in the denomination-specific storing and ejecting units 53*a* to 53*d*, respectively, unfit notes (of all denominations) are stored in the denomination-specific storing and ejecting unit 53*e*, and 100 euro, 200 euro, and 500 euro notes are stored in the denomination-specific storing and ejecting unit 53*f*.

In the storing destination setting pattern 2, abnormal banknotes and small denomination unfit notes (5 euro, 10 euro, 20 euro, and 50 euro notes) are stored in the reject box 52, 5 euro, 10 euro, 20 euro, 50 euro, and 100 euro notes are stored in the denomination-specific storing and ejecting units 53*a* to 53*e*, respectively, and 200 euro and 500 euro notes and large denomination unfit notes (200 euro and 500 euro notes) are stored in the denomination-specific storing and ejecting unit 53*f*.

In the storing destination setting pattern 3, abnormal banknotes are stored in the reject box 52, 5 euro, 10 euro, 20 euro, 50 euro, and 100 euro notes are stored in the denomination-specific storing and ejecting units 53*a* to 53*e*, respectively, and 200 euro and 500 euro notes and unfit notes (of all denominations) are stored in the denomination-specific storing and ejecting unit 53*f*.

In the storing destination setting pattern 4, abnormal banknotes and unfit notes (of all denominations) are stored in the reject box 52, 5 euro, 10 euro, 20 euro, 50 euro, and 100 euro notes are stored in the denomination-specific storing and ejecting units 53*a* to 53*e*, respectively, and 200 euro and 500 euro notes are stored in the denomination-specific storing and ejecting unit 53*f*.

As in the storing destination setting pattern 4, when setting is made so that abnormal banknotes and unfit notes (of all denominations) are stored in the reject box 52, in a case where the banknote depositing and dispensing machine 11 is used in a place with a high unfit note recognition frequency, the reject box 52 easily becomes full, however, by setting any of the storing destination setting patterns 1 to 3 and storing a part or all of unfit notes in the denomination-specific storing and ejecting units 53*a* to 53*f*, the frequency of the reject box 52 becoming full is reduced.

The control unit 71 has a function of, in a depositing process, transporting normal banknotes to the escrow unit 28, and after a deposit is approved, re-recognizing the banknotes in the escrow unit 28, and determining to transport unfit notes other than stained notes, judged as disallowed to be dispensed to the outlet 16 according to a re-recognition result and the kind set by the dispensing unfit money kind setting unit 72, to the reject box 52, and determining to transport stained notes judged as allowed to be dispensed to the outlet 16 to the corresponding denomination-specific storing and ejecting units 53 based on information set by the storing money setting unit 73. The control unit 71 also has a function of, in a dispensing process, transporting banknotes of a denomination unnecessary to be dispensed to the escrow unit 28 when the banknotes of the denomination unnecessary to be dispensed are ejected from the denomination-specific storing and ejecting unit 53 storing normal banknotes of a plurality of denominations in a mixed state, or ejected from the denomination-specific storing and ejecting unit 53 storing normal banknotes of a plurality of denominations and unfit notes other than stained notes in a mixed state based on the storing money setting unit 73, and after a predetermined quantity of banknotes to be dispensed are ejected to the outlet 16, transporting notes of a denomination unnecessary to be dispensed which have been transported to the escrow unit 28, to the corresponding denomination-specific storing and ejecting unit 53.

Next, operations of the banknote depositing and dispensing machine 11 will be described.

First, a depositing process will be described with reference to FIG. 5 and FIG. 6.

At the counter of a financial institution, a teller inserts banknotes to be deposited which the teller received from a customer into the inlet 17 and operates to start a depositing process through the teller's terminal.

Figure 5:
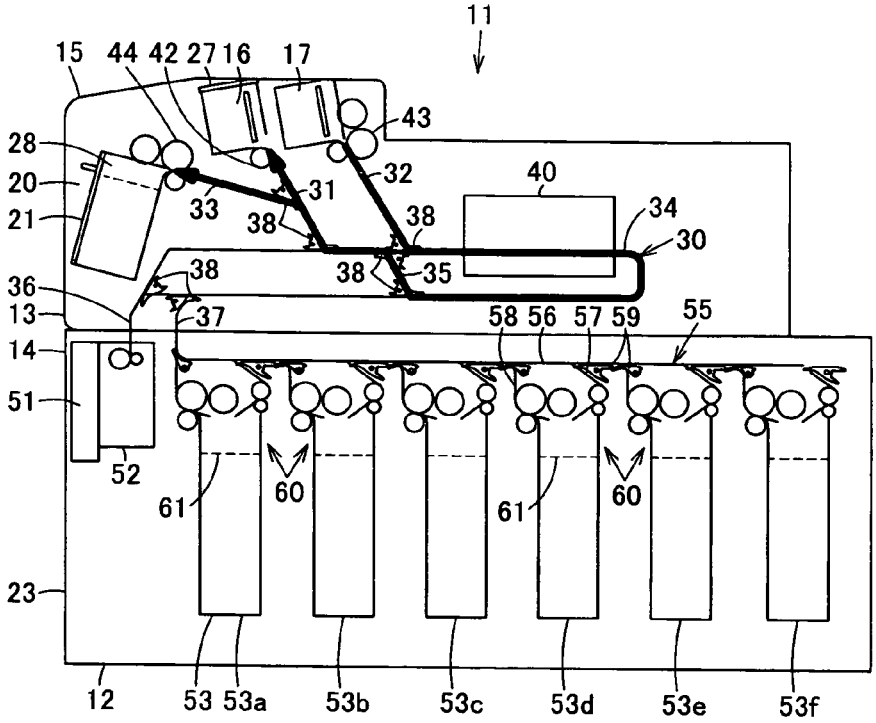
FIG. 5 is an explanatory view showing a flow until escrow of banknotes to be deposited in a depositing process of the same banknote depositing and dispensing machine.
Figure 6:
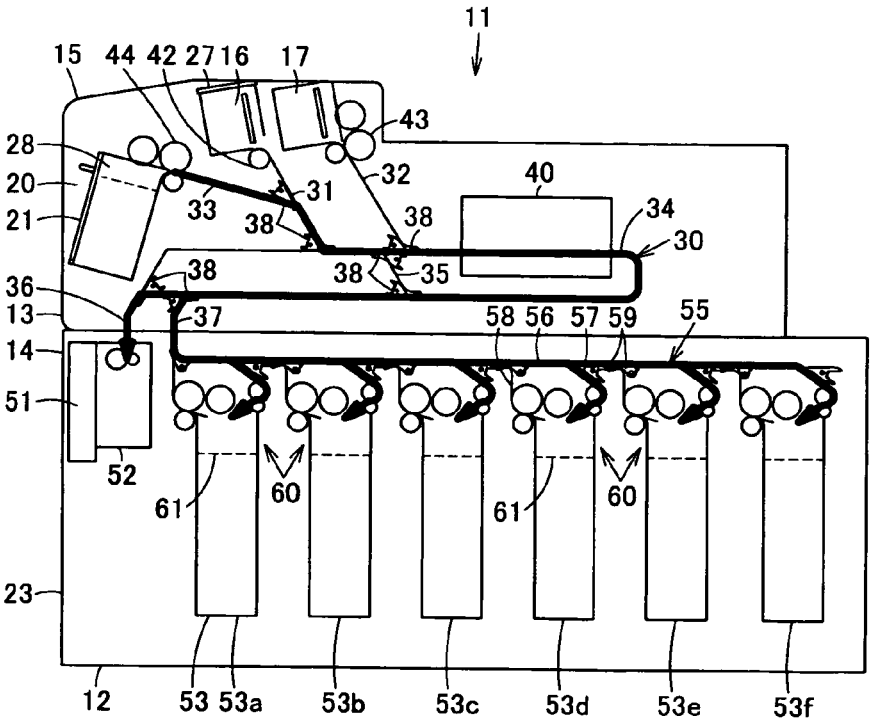
FIG. 6 is an explanatory view showing a flow of storing of escrowed banknotes in a depositing process of the same banknote depositing and dispensing machine.

As shown in FIG. 5, the banknotes to be deposited which are inserted in the inlet 17 are fed out from the inlet 17 one by one to the deposit transport unit 32, and transported to one end side of the recognition transport unit 34 and recognized by the recognition unit 40.

Banknotes to be deposited which are recognized as regular by the recognition unit 40, that is, normal banknotes and unfit notes are fed from the other end side of the recognition transport unit 34, through the bypass transport unit 35, one end side of the recognition transport unit 34, the dispensing transport unit 31, and the escrow transport unit 33, and then into the escrow unit 28 to be escrowed.

A banknote to be deposited which is recognized as unrecognizable by the recognition unit 40, that is, an abnormal banknote is fed from the other end side of the recognition transport unit 34 into the outlet 16 through the bypass transport unit 35, one end side of the recognition transport unit 34, and the dispensing transport unit 31, and at a timing at which escrow of the banknotes to be deposited is ended, the shutter 27 is opened and the abnormal banknote is returned to the teller. After the abnormal banknote is taken out by the teller from the outlet 16, the shutter 27 is closed. A predetermined process such as confirmation of the taken-out abnormal banknote is performed by the teller.

When the process is completed up to the escrow of all banknotes to be deposited inserted in the inlet 17, a recognition result is displayed on the terminal of the teller, and approval or disapproval of a deposit is confirmed with the customer.

By issuing a deposit approval instruction through the terminal by the teller, an operation of storing banknotes escrowed in the escrow unit 28 is started. As shown in FIG. 6, banknotes in the escrow unit 28 are fed out from the escrow unit 28 one by one to the escrow transport unit 33, and transported to the recognition transport unit 34 through the dispensing transport unit 31 and re-recognized by the recognition unit 40.

Here, for example, when the storing destination setting pattern 4 shown in FIG. 4 is set, as a result of re-recognition by the recognition unit 40, normal banknotes and stained notes among unfit notes are transported from the recognition transport unit 34 to the main transport unit 56 of the lower unit side transport unit 55 through the storing and dispensing transport unit 37, and fed from the main transport unit 56 into the denomination-specific storing and ejecting unit 53 set as a storing destination and stacked and stored there. When an abnormal banknote and an unfit note other than a stained note are recognized, they are fed from the recognition transport unit 34 into the reject box 52 through the reject transport unit 36 and stored there.

When the storing destination setting pattern 3 shown in FIG. 4 is set, normal banknotes and stained notes among unfit notes are handled in the same manner as with the storing destination setting pattern 4, however, unfit notes of all denominations other than the stained notes are transported from the recognition transport unit 34 to the main transport unit 56 of the lower unit side transport unit 55 through the storing and dispensing transport unit 37, and fed from this main transport unit 56 into the denomination-specific storing and ejecting unit 53*f* set as the storing destination and stored there while being mixed with normal banknotes. Further, only abnormal banknotes are transported to and stored in the reject box 52 from the recognition transport unit 34 through the reject transport unit 36.

On the other hand, by issuing a deposit disapproval instruction through the terminal by the teller, the electromagnetic lock locking the return port door 21 of the escrow unit 28 is unlocked. By the teller, the return port door 21 is opened and banknotes in the escrow unit 28 are collectively taken out from the return port 20 and returned to the customer, and the return port door 21 is closed.

Next, a dispensing process will be described.

At a counter of a financial institution, dispensing information such as an amount of money including denominations and the number of notes according to a customer's request for dispensing is input through a terminal of a teller, and a dispensing start is operated, and accordingly, a dispensing process is started.

As the dispensing process, there are a single denomination dispensing method in which banknotes are dispensed from the denomination-specific storing and ejecting unit 53 storing banknotes of a single denomination, and a selective denomination dispensing method in which only banknotes necessary to be dispensed are selectively dispensed when money is dispensed from the denomination-specific storing and ejecting unit 53 storing banknotes of a plurality of denominations in a mixed state or storing normal banknotes and unfit notes other than stained notes in a mixed state.

Figure 7:
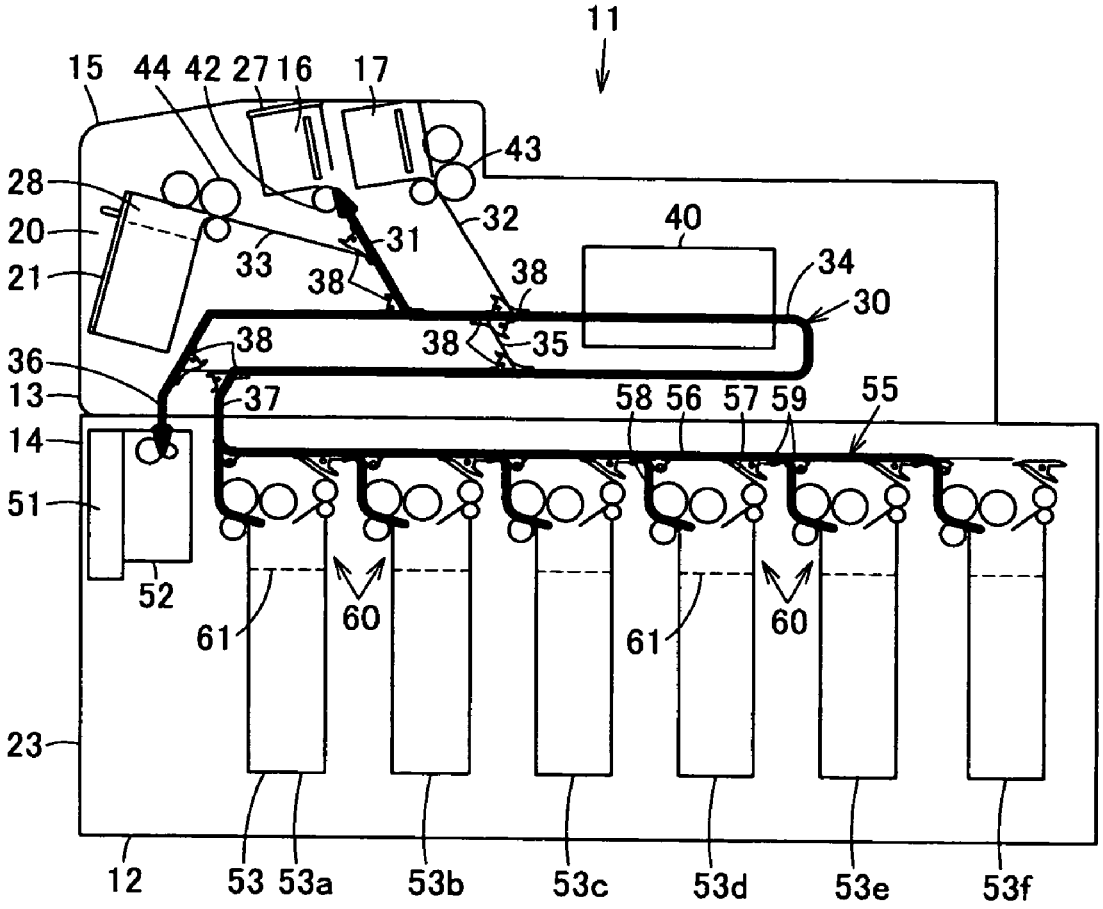
FIG. 7 is an explanatory view showing a banknote flow when banknotes are dispensed from a denomination-specific storing and ejecting unit which stores money of a single denomination in a dispensing process of the same banknote depositing and dispensing machine.

First, the single denomination dispensing method is shown in FIG. 7.

When banknotes of a single denomination are dispensed, banknotes are fed out one by one from only the denomination-specific storing and ejecting unit 53 storing banknotes of the corresponding denomination, and when banknotes of a plurality of denominations are dispensed, banknotes are fed out one by one in a preset order of denominations in such a manner that banknotes are fed out one by one from the denomination-specific storing and ejecting unit 53 storing a certain denomination, and after this feeding is completed, banknotes are fed out one by one from the denomination-specific storing and ejecting unit 53 storing banknotes of the next denomination.

Banknotes fed out from the denomination-specific storing and ejecting units 53 are transported to the recognition transport unit 34 via the storing and dispensing transport unit 37 of the upper unit side transport unit 30 through the feed-out transport unit 58 and the main transport unit 56, and re-recognized (the banknotes have already been recognized once when they are deposited) by the recognition unit 40.

Normal banknotes recognized as regular by the recognition unit 40 and stained notes among unfit notes are fed from the recognition transport unit 34 into the outlet 16 through the dispensing transport unit 31.

When an unrecognizable abnormal banknote and an unfit note other than a stained note are recognized by the recognition unit 40, they are fed from the recognition transport unit 34 into the reject box 52 of the lower unit 14 through the reject transport unit 36 and stored there.

After banknotes to be dispensed corresponding to an amount of money to be dispensed are fed into the outlet 16, the shutter 27 is opened. After the banknotes to be dispensed are taken out from the outlet 16 by the teller, the shutter 27 is closed. The dispensed banknotes are passed to the customer by the teller.

Figure 8:
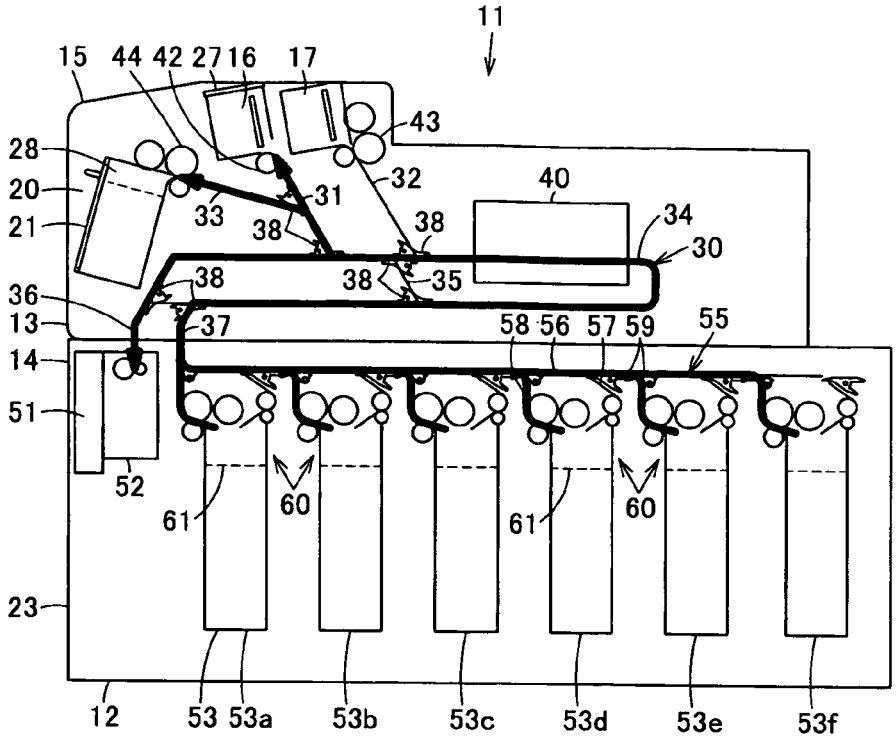
FIG. 8 is an explanatory view showing a banknote flow when banknotes necessary to be dispensed are selectively dispensed from a denomination-specific storing and ejecting unit which stores money of a plurality of denominations in a mixed state in a dispensing process of the same banknote depositing and dispensing machine.

FIG. 8 shows a selective denomination dispensing method.

The process from feeding out notes from the denomination-specific storing and ejecting units 53 to recognizing notes is the same as in the single denomination dispensing method. However, from the denomination-specific storing and ejecting unit 53 storing various notes in a mixed state, banknotes of a denomination unnecessary to be dispensed may be fed out in addition to denominations to be dispensed.

Normal banknotes of denominations to be dispensed which are recognized as regular by the recognition unit 40 or stained notes among unfit notes are fed from the recognition transport unit 34 into the outlet 16 through the dispensing transport unit 31.

Banknotes recognized as having a denomination unnecessary to be dispensed by the recognition unit 40 are fed from the recognition transport unit 34 into the escrow unit 28 through the dispensing transport unit 31 and the escrow transport unit 33 and stored there.

When an unrecognizable abnormal banknote is recognized by the recognition unit 40, the abnormal banknote is fed from the recognition transport unit 34 into the reject box 52 of the lower unit 14 through the reject transport unit 36, and stored there.

After banknotes to be dispensed corresponding to an amount of money to be dispensed are fed into the outlet 16, the shutter 27 is opened. After the banknotes to be dispensed are taken out from the outlet 16 by the teller, the shutter 27 is closed. The dispensed banknotes are passed to the customer by the teller.

Figure 9:
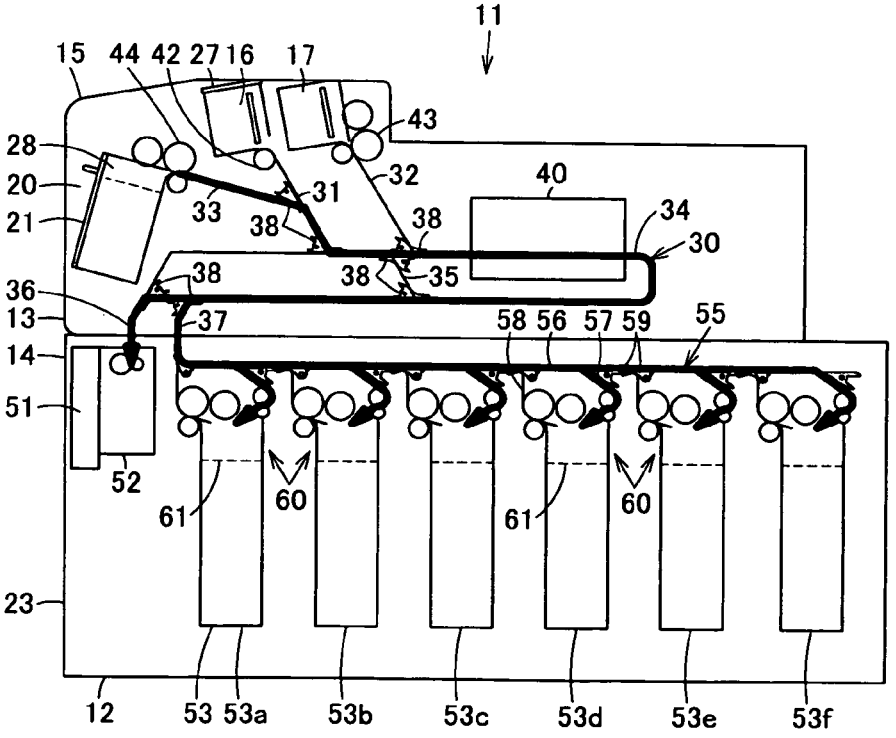
FIG. 9 is an explanatory view showing a flow of storing of banknotes of a denomination unnecessary to be dispensed after banknotes necessary to be dispensed are selectively dispensed from the denomination-specific storing and ejecting unit which stores money of a plurality of denominations in a mixed state in a dispensing process of the same banknote depositing and dispensing machine.

Thereafter, as shown in FIG. 9, a process of returning banknotes unnecessary to be dispensed, stored in the escrow unit 28, to the original denomination-specific storing and ejecting unit 53 is performed. Specifically, banknotes unnecessary to be dispensed, stored in the escrow unit 28, are fed one by one from the escrow unit 28 to the escrow transport unit 33, and transported to the recognition transport unit 34 through the dispensing transport unit 31 and re-recognized by the recognition unit 40.

As a result of re-recognition, normal banknotes and stained notes are transported from the recognition transport unit 34 to the main transport unit 56 of the lower unit side transport unit 55 through the storing and dispensing transport unit 37, and fed from the main transport unit 56 into the original denomination-specific storing and ejecting unit 53 set as a storing destination and stored there.

When an abnormal banknote and an unfit note other than, a stained note are recognized, they are fed from the recognition transport unit 34 into the reject box 52 through the reject transport unit 36 and stored there.

Thus, in a dispensing process, banknotes recognized as normal banknotes by the recognition unit 40 are transported to the outlet 16, and among banknotes recognized as unfit notes, according to the kinds of the unfit notes, it is determined whether stained notes are allowed to be dispensed to the outlet 16, and unfit notes of a specific kind are not rejected but handled as banknotes to be dispensed, and accordingly, reduction in banknotes recyclable as banknotes to be dispensed in the denomination-specific storing and ejecting units 53 is suppressed, and suspension of transactions due to a shortage of banknotes to be dispensed can be prevented.

In particular, in a dispensing process, among banknotes recognized as unfit notes by the recognition unit 40, for example, stained notes set as allowed to be dispensed according to the kind set by the dispensing unfit money kind setting unit 72 are transported to the outlet 16 and, for example, banknotes other than stained notes, set as disallowed to be dispensed, are transported to the reject box 52, and accordingly, only stained notes that are a set specific kind can be handled as banknotes to be dispensed without being rejected, and for example, even when the banknote depositing and dispensing machine 11 is used in a place in which unfit notes are highly frequently recognized, suspension of transactions due to a shortage of banknotes to be dispensed in the denomination-specific storing and ejecting units 53 and suspension of transactions due to the reject box 52 being full can be prevented.

The dispensing unfit money kind setting unit 72 can arbitrarily and selectively set any one or a combination of, in addition to stained notes, thickened notes, deformed notes, and fatigued notes, etc., as a kind of unfit notes allowed to be dispensed to the outlet 16.

For each of the plurality of denomination-specific storing and ejecting units 53, any setting of storing unfit notes of all denominations and a plurality of normal banknotes in a mixed state, storing unfit notes of a specific denomination and a plurality of normal banknotes in a mixed state, storing only unfit notes of all denominations, and storing only unfit notes of a specific denomination can be made by the storing money setting unit 73, so that many unfit notes can be stored by using the denomination-specific storing and ejecting units 53, and the frequency of the reject box 52 becoming full can be reduced.

In a depositing process, normal banknotes are transported to the escrow unit 28, and after a deposit is approved, banknotes in the escrow unit 28 are re-recognized, and unfit notes other than stained notes, judged as disallowed to be dispensed to the outlet 16 according to a re-recognition result and the kind set by the dispensing unfit money kind setting unit 72, are determined to be transported to the reject box 52, and stained notes judged as allowed to be dispensed to the outlet 16 are transported to the corresponding denomination-specific storing and ejecting unit 53 based on information set by the storing money setting unit 73 and can be handled as normal banknotes.

In a dispensing process, based on the storing money setting unit 73, when money is dispensed from the denomination-specific storing and ejecting unit 53 storing normal banknotes of a plurality of denominations in a mixed state or the denomination-specific storing and ejecting unit 53 storing normal banknotes of a plurality of denominations and unfit notes other than stained notes in a mixed state, in a case where a banknote of a denomination unnecessary to be dispensed is ejected from the denomination-specific storing and ejecting unit 53, the banknote of the denomination unnecessary to be dispensed is transported to the escrow unit 28, and after a predetermined quantity of banknotes to be dispensed are ejected to the outlet 16, the banknote of the denomination unnecessary to be dispensed which has been transported to the escrow unit 28 is transported to this denomination-specific storing and ejecting unit 53, and accordingly, only banknotes necessary to be dispensed can be selectively dispensed.

A plurality of recognition units may be provided for depositing and dispensing, etc., respectively.

Figure 10:
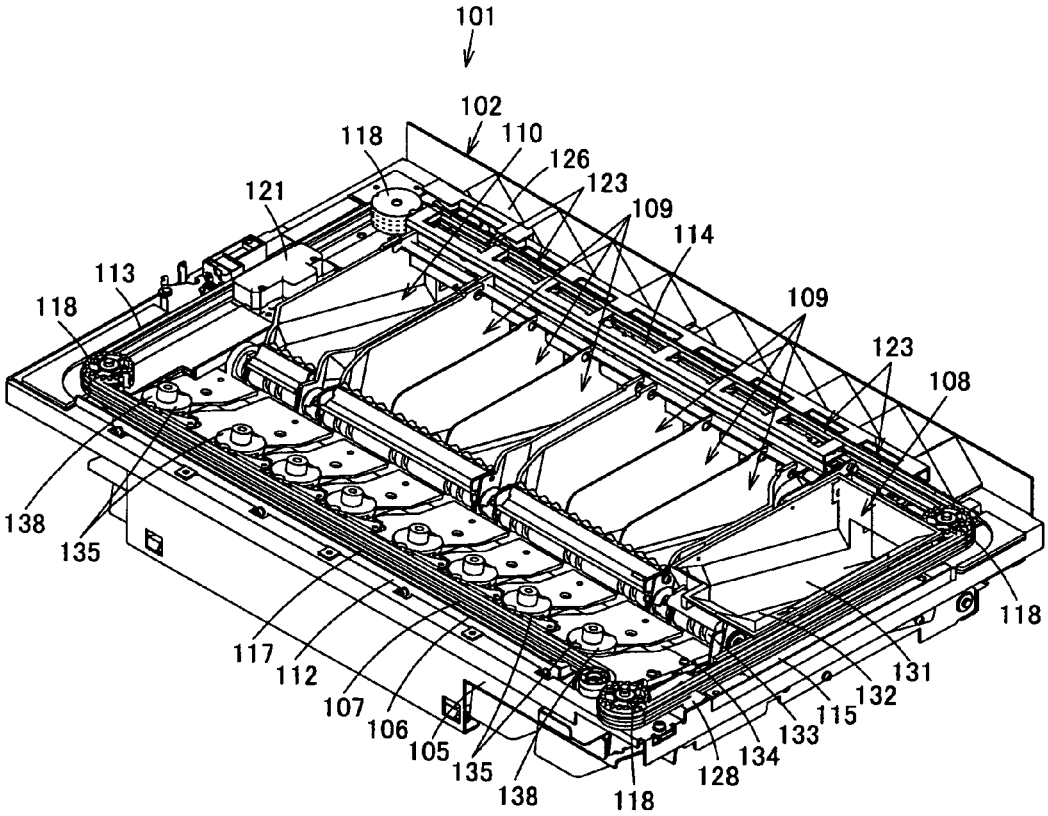
FIG. 10 is a perspective view of a coin processing device of a coin depositing and dispensing machine showing a second embodiment of a money depositing and dispensing machine of the present invention.
Figure 11:
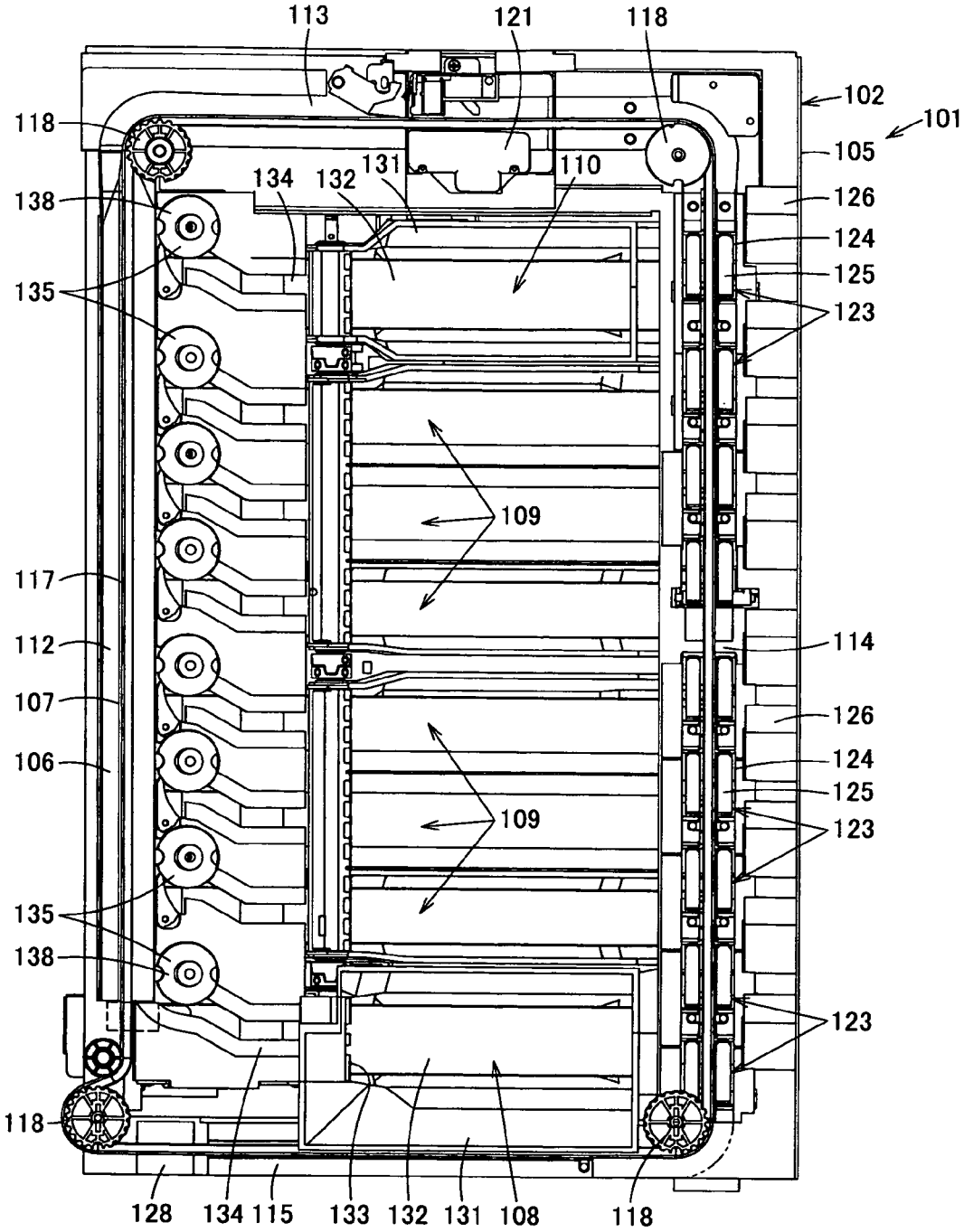
FIG. 11 is a plan view of the coin processing device of the same coin depositing and dispensing machine.
Figure 12:
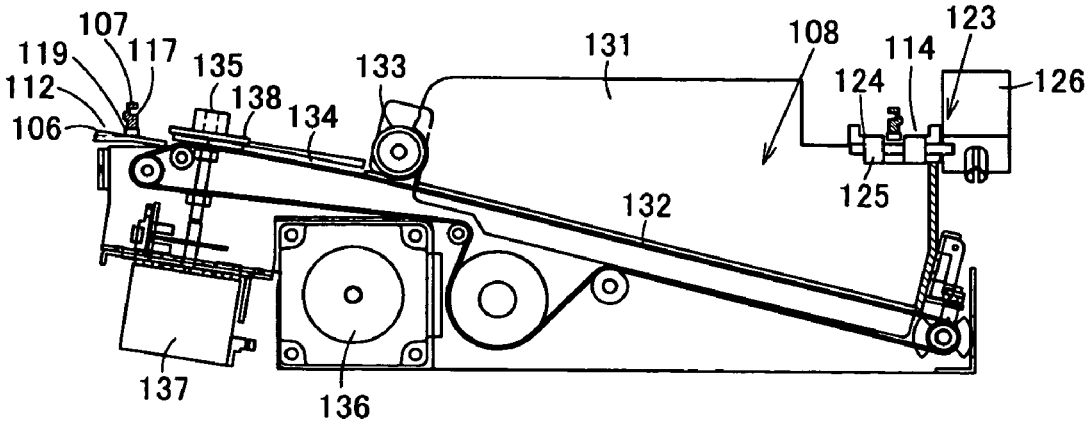
FIG. 12 is a sectional view of the coin processing device of the same coin depositing and dispensing machine.

Next, a second embodiment is shown in FIG. 10 to FIG. 12.

A coin depositing and dispensing machine 101 as a money depositing and dispensing machine which handles coins as money is shown.

FIG. 10 to FIG. 12 show a coin processing device 102 which is disposed inside a machine body not shown of the coin depositing and dispensing machine 101. On the front side upper portion of the machine body, an inlet for inputting coins to be deposited into the coin processing device 102 is disposed, and outlets for dispensing coins to be dispensed which are ejected from the coin processing device 102 are provided on the right side and the left side of the front face of the machine body.

The coin processing device 102 has a quadrilateral frame 105 long in the front-rear direction, and on this frame 105, an annular coin path 106 is formed, and a transporter 107 with an annular structure for transporting coins in the coin path 106 is disposed.

In the inside area of the coin path 106 and the transporter 107, a deposit feeding unit 108 which receives coins input from the inlet of the machine body and can feed out the coins one by one to the coin path 106, a plurality of denomination-specific storing and ejecting units 109 which store coins by denomination and feed out the coins one by one to the coin path 106, and an escrow unit 110 which collectively escrows coins after the coins are recognized in a depositing process and can feed out the coins one by one to the coin path 106, are disposed in order from the front face side to the back side. The deposit feeding unit 108, the denomination-specific storing and ejecting units 109, and the escrow unit 110 have the same basic configuration, and are configured to have a structure for storing unarrayed coins and feeding out coins one by one.

The coin path 106 and the transporter 107 form a transport unit which transports a next coin. In the region from the front side to the back side along the left side of the frame 105, the deposit feeding unit 108, the denomination-specific storing and ejecting units 109, and a receiving transport unit 112 which receives coins fed out one by one from the escrow unit 110 and transports the coins, are formed. In the region from the left side to the right side along the rear side of the frame 105, a recognition transport unit 113 which recognizes coins while transporting the coins is formed. In the region from the back side to the front side along the right side of the frame 105, a sorting transport unit 114 which sorts coins while transporting the coins is formed. In the region from the right side to the left side along the front side of the frame 105, a dispensing transport unit 115 which transports coins so as to dispense the coins to the outlet on the left side of the machine body is formed.

The transporter 107 has an annular transporting belt 117 and a plurality of pulleys 118 supporting the transporting belt 117 rotatably along the coin path 106. Any one of the pulleys 118 is driven to rotate by a motor not shown, and the transporting belt 117 is rotated in the transporting direction (clockwise in FIG. 11). On the transporting belt 117, a plurality of protrusions 119 which protrude downward from the lower surface of the transporting belt 117 and pushes and transports coins one by one inside the coin path 106 are provided at predetermined intervals along the belt longitudinal direction.

In the recognition transport unit 113 of the coin path 106, a recognition unit 121 which recognizes denominations, fitness, and kinds of unfit coins by detecting materials, thicknesses, and diameters of coins, is disposed.

In the sorting transport unit 114 of the coin path 106, an escrow unit 110, denomination-specific storing and ejecting units 109, a deposit feeding unit 108, and diverting units 123 which selectively divert coins to the outlet on the right side of the machine body, are formed. In each diverting unit 123, a diverting port 124 which enables coins to fall down to the bottom surface of the coin path 106 is provided, and in this diverting port 124, a diverting gate 125 for selectively diverting coins is disposed in an openable and closable manner, and this diverting gate 125 is opened and closed by a solenoid 126.

At the terminal end of the dispensing transport unit 115 of the coin path 106, a diverting unit 128 which diverts coins to the outlet on the left side of the machine body is disposed. This diverting unit 128 is formed as an opening in which coins fall.

The deposit feeding unit 108 includes a storing frame 131 which receives and stores coins inputted from the inlet on the upper side and unarrayed coins fed in from the coin path 106, an endless belt 132 disposed along the left-right direction on the bottom surface of the storing frame 131, a reverse roller 133 which is disposed in the downstream side area in the transporting direction above the belt 132 and rotates in reverse to the rotation of the belt 132 in the transporting direction to array unarrayed coins on the belt 132 in line in a single layer and feed out the coins, a feed-out path 134 which feeds out coins which passed through the reverse roller 133 to the receiving transport unit 112 of the coin path 106, and a delivering unit 135 which delivers coins fed out one by one from the feed-out path 134 to the protrusions 119 of the transporting belt 117.

The belt 132 is laid so as to slope and rise toward the downstream side in the transporting direction from the upstream side in the transporting direction, and is driven to rotate in the transporting direction by a motor 136 common to the deposit feeding unit 108, the denomination-specific storing and ejecting units 109, and the escrow unit 110.

The reverse roller 133 is rotated in reverse to the upper surface of the belt 132 rotating in the transporting direction by a motor 136 which drives the belt 132.

The delivering unit 135 has a circular cam 138 which is driven to rotate by a pulse motor 137. On the lower surface of the cam 138, a pair of groove portions which allow coins fed out from the feed-out path 134 to enter one by one are formed at positions symmetrical on the circumference of the peripheral edge portion. The cam 138 at a fixed position is set at a stop position at which a coin enters one of the groove portions, and is controlled so as to rotationally move by 180 degrees at a timing at which the coin can be delivered to the protrusion 119 of the transporting belt 117 according to the position of the protrusion 119, deliver the coin inside the one of the groove portions to the protrusion 119 of the transporting belt 117, stop at a next fixed position at which a subsequent coin from the feed-out path 134 enters the other groove portion, and wait for the next delivering operation.

The denomination-specific storing and ejecting units 109 and the escrow unit 110 have the same basic configuration as that of the deposit feeding unit 108, that is, include a storing frame 131, a belt 132, a reverse roller 133, a feed-out path 134, and a delivering unit 135, etc. From the denomination-specific storing and ejecting units 109 and the escrow unit 110, coins can be fed out one by one to the receiving transport unit 112 of the coin path 106, and the denomination-specific storing and ejecting units 109 and the escrow unit 110 can receive and store coins diverted by the corresponding diverting units 123 of the sorting transport unit 114 of the coin path 106.

The coin depositing and dispensing machine 101 includes a control unit not shown which controls operations including a coin processing operation to be performed by the coin processing device 102. This control unit performs the same control as in the above-described first embodiment for handling of unfit coins and setting of storing destinations of coins of various denominations. For example, the control unit has functions including a function of, in a dispensing process, transporting normal coins which are regular and not unfit coins to the outlet among coins fed out from the denomination-specific storing and ejecting units 109 and recognized by the recognition unit 121, and judging whether coins recognized as regular but unfit coins are allowed to be dispensed to the outlet according to the kinds of the unfit coins. Further, the coin depositing and dispensing machine 101 includes a dispensing unfit money kind setting unit 72 capable of setting a kind of unfit coins allowed to be dispensed to the outlet, and a storing money setting unit 73 which can make any one setting of storing unfit coins of all denominations and a plurality of normal coins in a mixed state, storing unfit coins of a specific denomination and a plurality of normal coins in a mixed state, storing only unfit coins of all denominations, and storing only unfit coins of only a specific denomination, for each of the plurality of denomination-specific storing and ejecting units 109. The settable kinds of unfit coins include stained coins more stained as compared with normal coins and deformed coins with sizes different from the size of normal coins, etc., and as the stained coins, thickness abnormal coins and diameter abnormal coins caused by adhesion of dirt can be recognized.

Next, operations of the coin depositing and dispensing machine 101 will be described.

First, a depositing process will be described.

Coins to be deposited which are put into the deposit feeding unit 108 through the inlet are fed out one by one from the deposit feeding unit 108 and delivered to the protrusions 119 of the transporting belt 117 being rotated in the receiving transport unit 112 of the coin path 106.

The coins to be deposited are pushed and moved by the protrusions 119 of the transporting belt 117 and transported from the receiving transport unit 112 to the recognition transport unit 113 of the coin path 106, and recognized by the recognition unit 121 of the recognition transport unit 113.

As a result of recognition by the recognition unit 121, coins to be deposited which are recognized as normal coins and unfit coins are transported from the recognition transport unit 113 to the sorting transport unit 114, diverted by the diverting unit 123 corresponding to the escrow unit 110, and stored in the escrow unit 110.

The denomination-specific storing and ejecting units 109 and the escrow unit 110 maintain a hold state of feeding out of coins at the delivering unit 135, so that stored coins are not fed out.

As a result of recognition by the recognition unit 121, when a coin is recognized as an unrecognizable abnormal coin, this abnormal coin is transported from the recognition transport unit 113 to the sorting transport unit 114, and diverted by the diverting unit 123 on the most downstream side corresponding to the outlet on the right side of the machine body and returned to the outlet on the right side, or transported from the sorting transport unit 114 to the dispensing transport unit 115, diverted by the diverting unit 128 corresponding to the outlet on the left side of the machine body and returned to the outlet on the left side.

Then, after escrowing the coins to be deposited, when storing is instructed, the coins in the escrow unit 110 are stored by denomination. That is, the escrowed coins are fed out one by one from the escrow unit 110 and delivered to the protrusions 119 of the transporting belt 117 being rotated in the receiving transport unit 112 of the coin path 106.

The coins are pushed and moved by the protrusions 119 of the transporting belt 117 and transported from the receiving transport unit 112 to the recognition transport unit 113 of the coin path 106, and recognized by the recognition unit 121 of the recognition transport unit 113.

As a result of recognition by the recognition unit 121, coins recognized as normal coins and stained coins among unfit coins are transported from the recognition transport unit 113 to the sorting transport unit 114, and according to the setting of the storing money setting unit 73, diverted by the diverting units 123 corresponding to the corresponding denomination-specific storing and ejecting units 109, and stored in the denomination-specific storing and ejecting units 109 by denomination.

As a result of recognition by the recognition unit 121, when unrecognizable abnormal coins or unfit coins other than stained coins are recognized, these coins are transported from the recognition transport unit 113 to the sorting transport unit 114, and diverted by the diverting unit 123 on the most downstream side corresponding to the outlet on the right side of the machine body and dispensed to the outlet on the right side, or transported from the sorting transport unit 114 to the dispensing transport unit 115, diverted by the diverting unit 128 corresponding to the outlet on the left side of the machine body, and dispensed to the outlet on the left side. Abnormal coins and unfit coins other than stained coins may be stored in the denomination-specific storing and ejecting units 109 according to the setting of the storing money setting unit 73, or may be diverted by the diverting unit 123 corresponding to the outlet on the right side of the machine body and guided to and stored in a rejected coin storing unit (a collection box or a reject box) not shown disposed at the lower side inside the machine body by a switching unit not shown disposed below the diverting unit 123. Then, the coins dispensed to the outlet are taken out and subjected to processing such as confirmation by a teller.

When a counting result is not approved and return is instructed, the escrowed coins are returned. That is, escrowed coins are fed out one by one from the escrow unit 110 and delivered to the protrusions 119 of the transporting belt 117 being rotated in the receiving transport unit 112 of the coin path 106.

The coins are pushed and moved by the protrusions 119 of the transporting belt 117 and transported from the receiving transport unit 112 to the recognition transport unit 113 of the coin path 106, and recognized by the recognition unit 121 of the recognition transport unit 113. The recognized coins are transported from the recognition transport unit 113 to the sorting transport unit 114, and diverted by the diverting unit 123 on the most downstream side corresponding to the outlet on the right side of the machine body and returned to the outlet on the right side, or transported from the sorting transport unit 114 to the dispensing transport unit 15, diverted by the diverting unit 128 corresponding to the outlet on the left side of the machine body and returned to the outlet on the left side.

Next, a dispensing process will be described.

When a dispensing instruction including a denomination and the number of coins to be dispensed or an amount of money to be dispensed is received, the denomination-specific storing and ejecting unit 109 corresponding to the denomination to be dispensed feeds out coins to be dispensed one by one and delivered to the protrusions 119 of the transporting belt 117 being rotated in the receiving transport unit 112 of the coin path 106. The denomination-specific storing and ejecting unit 109 which does not correspond to the denomination to be dispensed and the denomination-specific storing and ejecting unit 109 which corresponds to the denomination to be dispensed but has already fed out the number of coins to be dispensed maintain a hold state of feeding out of coins at the delivering unit 135, so that coins are not fed out.

The coins to be dispensed are pushed and moved by the protrusions 119 of the transporting belt 117 and transported from the receiving transport unit 112 to the recognition transport unit 113 of the coin path 106, and recognized by the recognition unit 121 of the recognition transport unit 113.

As a result of recognition by the recognition unit 121, coins to be dispensed which are recognized as normal coins and stained coins among unfit coins are transported from the recognition transport unit 113 to the sorting transport unit 114, and diverted by the diverting unit 123 on the most downstream side corresponding to the outlet on the right side of the machine body and dispensed to the outlet on the right side, or transported from the sorting transport unit 114 to the dispensing transport unit 115, diverted by the diverting unit 128 corresponding to the outlet on the left side of the machine body and dispensed to the outlet on the left side.

As a result of recognition by the recognition unit 121, when unrecognizable abnormal coins, unfit coins other than stained coins, and coins of a denomination unnecessary to be dispensed, fed out to the coin path 106 in a case where coins of a plurality of denominations are stored in a mixed state in the denomination-specific storing and ejecting unit 109, are recognized, these coins are transported from the recognition transport unit 113 to the sorting transport unit 114, diverted by the diverting unit 123 corresponding to the original denomination-specific storing and ejecting unit 109, and returned to the original denomination-specific storing and ejecting unit 109. Abnormal coins and unfit coins other than stained coins may be stored in the denomination-specific storing and ejecting unit 109 according to the setting of the storing money setting unit 73, or may be diverted by the diverting unit 123 corresponding to the outlet on the right side of the machine body, and guided to and stored in a rejected coin storing unit (a collection box or a reject box) not shown disposed on the lower side inside the machine body by a switching unit not shown disposed below the diverting unit 123. When coins of a denomination unnecessary to be dispensed, fed out to the coin path 106 in a case where coins of a plurality of denominations are stored in a mixed state in the denomination-specific storing and ejecting unit 109, are recognized, it is possible that the coins are diverted to and escrowed in the escrow unit 110, and after the dispensing process is completed, the coins are fed out from the escrow unit 110 and returned to the original denomination-specific storing and ejecting unit 109. In this case, coins of the denomination unnecessary to be dispensed which have been returned to the denomination-specific storing and ejecting unit 109 are not fed out again. Then, coins corresponding to the shortfall are fed out from the denomination-specific storing and ejecting unit 109 to the coin path 106.

Thus, in a dispensing process, coins recognized as normal coins by the recognition unit 121 are transported to the outlet, and it is judged whether the coins recognized as unfit coins are allowed to be dispensed to the outlet according to the kinds of the unfit coins, and unfit coins of a specific kind are not rejected but handled as coins to be dispensed, and accordingly, reduction in coins recyclable as coins to be dispensed in the denomination-specific storing and ejecting units 109 is suppressed, and suspension of transactions due to a shortage of coins to be dispensed can be prevented.

In particular, in a dispensing process, among coins recognized as unfit coins by the recognition unit 121, for example, stained coins set as allowed to be dispensed according to the kind set by the dispensing unfit money kind setting unit 72 are transported to the outlet and, for example, coins other than stained coins, set as disallowed to be dispensed, are transported to the denomination-specific storing and ejecting units 109 or the rejected coin storing unit, and accordingly, only stained coins that are a set specific kind can be handled as coins to be dispensed without being rejected, and, for example, even when the coin depositing and dispensing machine 101 is used in a place in which unfit coins are highly frequently recognized, suspension of transactions due to a shortage of coins to be dispensed in the denomination-specific storing and ejecting units 109 can be prevented. Further, when the rejected coin storing unit is used for storing abnormal coins and unfit coins, suspension of transactions due to the rejected coin storing unit being full can be prevented.

Further, by the storing money setting unit 73, any setting of storing unfit coins of all denominations and a plurality of normal coins in a mixed state, storing unfit coins of a specific denomination and a plurality of normal coins in a mixed state, storing only unfit coins of all denominations, and storing only unfit coins of only a specific denomination can be made for each of the plurality of denomination-specific storing and ejecting units 109, and accordingly, a large volume of unfit coins can be stored by using the denomination-specific storing and ejecting units 109, and when the rejected coin storing unit is used for storing abnormal coins and unfit coins, the frequency of the rejected coin storing unit becoming full can be reduced.

Figure 13:
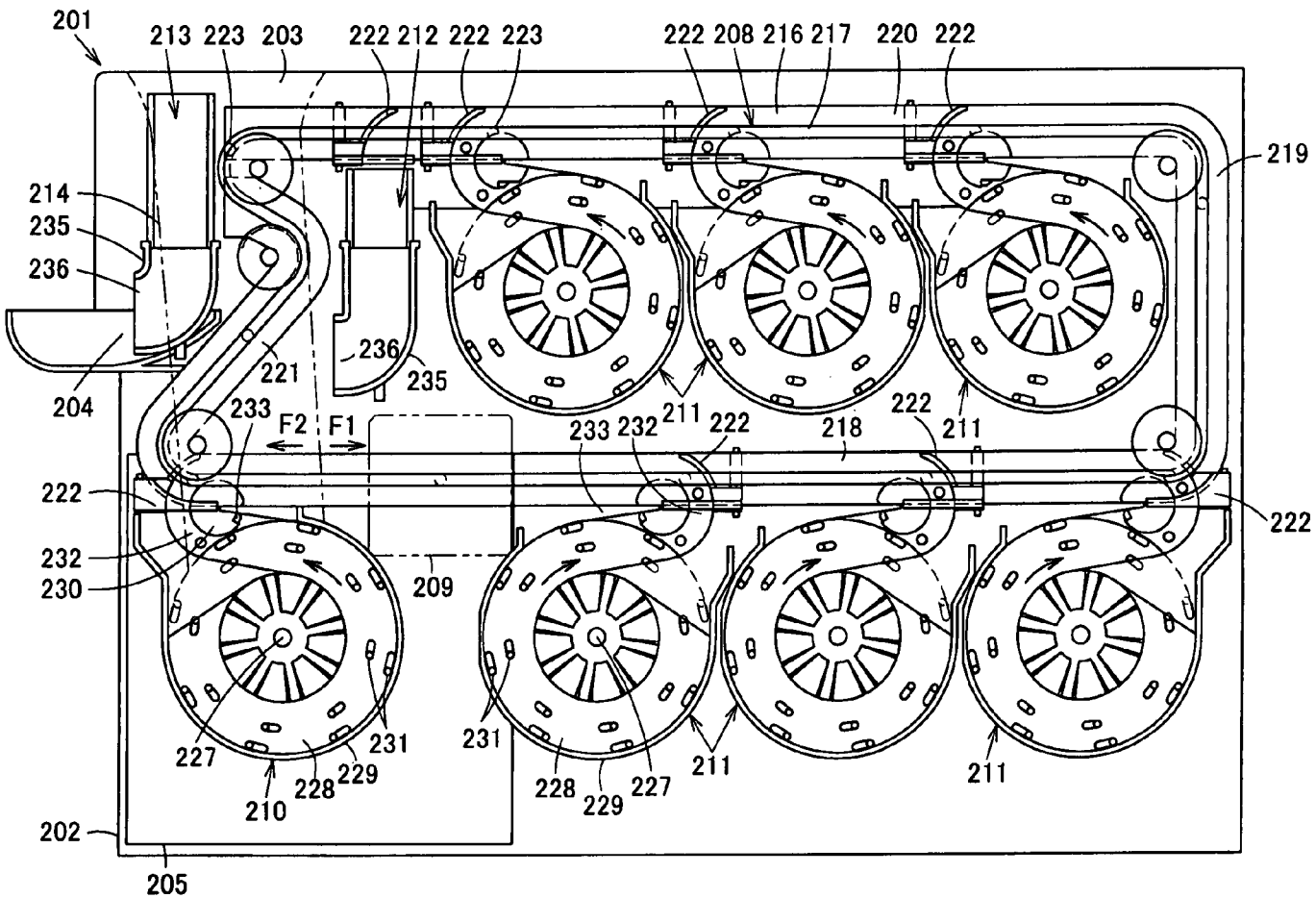
FIG. 13 is a schematic sectional view from a lateral side of a coin depositing and dispensing machine showing a third embodiment of a money depositing and dispensing machine of the present invention.

Next, a third embodiment is shown in FIG. 13.

A coin depositing and dispensing machine 201 which handles coins as money is shown as a money depositing and dispensing machine.

The coin depositing and dispensing machine 201 includes a machine body 202, an inlet 203 for inputting coins is disposed on the front side upper face of the machine body 202, and an outlet 204 for dispensing coins is disposed on the front face of the machine body 202. On the front face of the machine body 202, a coin cassette 205 is removably fitted to the machine body 202.

Inside the machine body 202, a base not shown having an upper portion inclined at a predetermined angle leftward as viewed from the front face of the machine body 202 is disposed, and on the surface side facing upward of the base, an annular transporter 208 which transports coins is disposed. In this transporter 208, a recognition unit 209 which properly selects and recognizes at least denominations, authenticity, and fitness of coins and kinds of unfit coins to be transported by the transporter 208 is disposed, and further, a pooling and feeding unit 210 which receives coins inputted into the inlet 203 and can feed out the coins one by one to the transporter 208, and can put coins one by one in and out of the transporter 208, and a plurality of denomination-specific storing and ejecting units 211 which store coins by denomination and can put coins one by one in and out of the transporter 208, an escrow unit 212 which can escrow coins to be deposited, and a dispensing escrow unit 213 which escrows coins to be dispensed, are connected. Between the inlet 203 and the pooling and feeding unit 210, a receiving chute 214 which guides coins inputted into the inlet 203 to the pooling and feeding unit 210 is disposed.

Then, the transporter 208 includes an annular coin path 216 which arrays coins in a line and guides transporting the coins, and an endless transporting belt 217 which transports coins in the coin path 216.

In the coin path 216, a first path portion 218 provided from the front side to the rear side of the machine body 202, a turned-back path portion 219 which is provided along the rear surface of the machine body 202 for turning-back from the rear end of the first path portion 218 to the front side of the machine body 202, a second path portion 220 which is formed from the turned-back path portion 219 to the front side of the machine body 202 and has a front end directed toward the dispensing escrow unit 213, and a dispensing path portion 221 which is provided from the front end of the first path portion 218 to the dispensing escrow unit 213 in parallel to the front end of the second path portion 220, are formed.

On the transporting belt 217, a plurality of protrusions 223 are provided at predetermined pitches in the belt longitudinal direction. The transporting belt 217 receives a coin between two protrusions 223 adjacent to each other, and transports the coin by rotation of the transporting belt 217 while pushing the coin by the protrusions 223. The transporting belt 217 is driven to rotate forward and reverse, that is, rotates in a first direction (hereinafter, referred to as a deposit transporting direction F1) as a forward direction so as to move from the front side to the rear side in the first path portion 218 in a depositing process in which coins are fed out from the pooling and feeding unit 210 and stored in the denomination-specific storing and ejecting units 211, and rotates in a second direction (hereinafter, referred to as a dispensing transporting direction F2) opposite to the deposit transporting direction F1 in a dispensing process in which coins are fed out from the denomination-specific storing and ejecting units 211 and dispensed to the outlet 204. Therefore, according to the forward and reverse rotations of the transporting belt 217, coins in the coin path 216 can be transported in both of the forward and reverse directions.

Below the first path portion 218 of the coin path 216, a pooling and feeding unit 210 is disposed at a front side position, and a plurality of, that is, for example, three denomination-specific storing and ejecting units 211 are disposed at positions behind the pooling and feeding unit 210 along the first path portion 218. Between the pooling and feeding unit 210 and the forefront denomination-specific storing and ejecting unit 211, a recognition unit 209 is disposed. Below the second path portion 220, a plurality of, for example, three denomination-specific storing and ejecting units 211 are disposed along the second path portion 220, and an escrow unit 212 is disposed in front of these denomination-specific storing and ejecting units 211. A dispensing escrow unit 213 is disposed so as to face the front end of the second path portion 220 and the front end of the dispensing path portion 221.

In the coin path 216, at the positions of the coin gateway of the pooling and feeding unit 210, the coin gateways of the denomination-specific storing and ejecting units 211, and the coin gateway of the escrow unit 212, gate members 225 are respectively provided which selectively distribute coins depending on whether the coins are to be put in and out or coins to be transported by the transporter 208 are to be passed to the downstream side in the transporting direction.

Each of the pooling and feeding unit 210 and the denomination-specific storing and ejecting units 211 include a rotary disk 228 rotatable around a rotation shaft 227 at a position inclined at a predetermined angle with respect to the horizontal direction, a hopper 229 which pools coins between the same and the surface side of the rotary disk 228, and a delivery disk 230 disposed near the coin gateway, etc.

The rotary disk 228 is inclined to the right with respect to the horizontal direction by the rotation shaft 227 attached rotatably to the base of the machine body 202 as viewed from the front face of the machine body 202, and is disposed so that the left side of the rotary disk 228 becomes higher and the right side becomes lower, and the surface on the rotary disk 228 comes to the diagonally upper right opposed to the machine body 202. The rotary disk 228 is driven to rotate by a motor in a feed-out rotating direction (the arrow direction in FIG. 13) for feeding out coins to the coin path 216 in conjunction with the transporting belt 217 and the delivery disk 230.

On the surface of the rotary disk 228, a plurality of pick-up members 231 protruding from the surface of the rotary disk 228 are disposed at predetermined pitches along two circumferential directions of the inner peripheral side circumferential direction and the outer peripheral side circumferential direction. When the rotary disk 228 is rotated in the feed-out rotating direction, each of the pick-up members 231 on the inner peripheral side holds one coin and picks the coin up to the area above the rotary disk 228, and each of the pick-up members 231 on the outer peripheral side pushes out the coin picked up to the area above the rotary disk 228 by each of the pick-up members 231 on the inner peripheral side to the coin gateway and delivers the coin to the delivery disk 230.

In the area above the rotary disk 228, a path portion 232 for feeding out a coin picked up to the area above the rotary disk 228 by the pick-up member 231 toward the coin path 216 is formed.

On the outer peripheral edge portion of the delivery disk 230, a protrusion 233 which comes into contact with the coin and feeds it out to the coin path 216 from the rotary disk 228 side is provided. The delivery disk 230 rotates in conjunction with the transporting belt 217 of the coin path 216, and when feeding out a coin, rotates in the feed-out rotating direction for feeding out a coin by the protrusion 233 to the coin path 216 through the path portion 232 from the rotary disk 228 side, and when receiving a coin, rotates in a direction in which the protrusion 233 moves from the coin path 216 side into the path portion 232 and which is opposite to the feed-out rotating direction.

The escrow unit 212 is disposed above the coin cassette 205 and the pooling and feeding unit 210, and includes a chute portion 235. This chute portion 235 has a hollow cylindrical shape, and in the upper area of the chute portion 235, a horizontal opening which receives coins distributed by the gate member 225 from the coin path 216 is formed, and in the lower area of the chute portion 235, an opening 236 opened sideward is formed so that the lower side of the chute portion 235 is bent toward the opening 236.

The chute portion 235 is rotatable around the vertical axis passing through the center of the chute portion 235. Around the region of the rotation of the opening 236 in the lower area of the chute portion 235, a closing member not shown which closes the opening 236 in the lower area when the chute portion 235 is positioned at an escrow position as a predetermined rotating position is disposed. At the escrow position of the chute portion 235 with the lower opening 236 closed by the closing member, a coin fed in from the upper opening is escrowed inside the chute portion 235, and when the chute portion 235 rotates to one side with respect to the closing member, the escrowed coin is ejected to the pooling and feeding unit 210, and when the chute portion 235 rotates to the other side with respect to the closing member, the escrowed coin is ejected to the coin cassette 205.

The dispensing escrow unit 213 is disposed above the outlet 204, and can receive coins ejected from the second path portion 220 or the dispensing path portion 221 of the coin path 216 from above, and has the same basic structure as that of the escrow unit 212. At the escrow position of the chute portion 235 with the lower opening 236 closed by the closing member, a coin fed in from the upper opening is escrowed inside the chute portion 235, and when the chute portion 235 rotates to one side with respect to the closing member, the escrowed coin is ejected to the outlet 204, and when the chute portion 235 rotates to the other side with respect to the closing member, the escrowed coin is ejected to the coin cassette 205.

The coin depositing and dispensing machine 201 includes a control unit not shown which controls the coin depositing and dispensing machine 201. This control unit performs the same control as in the first embodiment described above for handling of unfit coins and setting of storing destinations of coins of the respective denominations. The control unit has various functions including a function of, for example, in a dispensing process, among coins fed out from the denomination-specific storing and ejecting units 211 and recognized by the recognition unit 209, transporting normal coins which are regular and not unfit coins to the outlet 204, and judging whether coins recognized as regular but unfit coins are allowed to be dispensed to the outlet 204 based on the kinds of the unfit coins. Further, the coin depositing and dispensing machine 201 includes a dispensing unfit money kind setting unit 72 capable of setting a kind of unfit coins allowed to be dispensed to the outlet 204, and a storing money setting unit 73 capable of making any setting of storing unfit coins of all denominations and a plurality of normal coins in a mixed state, storing unfit coins of a specific denomination and a plurality of normal coins in a mixed state, storing only unfit coins of all denominations, and storing only unfit coins of only a specific denomination for each of the plurality of denomination-specific storing and ejecting units 211. The settable kinds of unfit coins include stained coins more stained as compared with normal coins and deformed coins with sizes different from the size of normal coins, and as the stained coins, thickness abnormal coins and diameter abnormal coins caused by adhesion of dirt can be recognized.

Next, operations of the coin depositing and dispensing machine 201 will be described.

First, a depositing operation will be described.

Coins to be deposited which are put into the pooling and feeding unit 210 from the inlet 203 are fed out one by one from the pooling and feeding unit 210 to the coin path 216, and the coins fed out into the coin path 216 are transported one by one in the deposit transporting direction F1 by the transporting belt 217, and coins transported in the coin path 216 are recognized by the recognition unit 209.

As a result of recognition by the recognition unit 209, coins recognized as normal coins and unfit coins are distributed to the escrow unit 212 by the gate member 225 of the escrow unit 212, and pooled in the chute portion 235 which has been rotated to the escrow position so that the lower opening 236 is closed by the closing member.

As a result of recognition by the recognition unit 209, unrecognizable abnormal coins are transported to the front end which is the terminal end of the second path portion 220, and ejected to the dispensing escrow unit 213, and ejected to the outlet 204 through the chute portion 235 which has been rotated to the ejecting position for ejection to the outlet 204 and returned.

After the coins to be deposited are escrowed, when a storing instruction is issued, the chute portion 235 of the escrow unit 212 is rotated from the escrow position to the ejecting position for ejection to the pooling and feeding unit 210, and coins pooled in the chute portion 235 of the escrow unit 212 are fed into the pooling and feeding unit 210.

Thereafter, the coins in the pooling and feeding unit 210 are fed out one by one to the coin path 216, and coins fed out into the coin path 216 are transported one by one in the deposit transporting direction F1 by the transporting belt 217, and the coins transported inside the coin path 216 are recognized by the recognition unit 209.

As a result of recognition by the recognition unit 209, coins recognized as normal coins and stained coins among unfit coins are distributed from the coin path 216 to the corresponding denomination-specific storing and ejecting units 211 by the gate members 225 of the denomination-specific storing and ejecting units 211 according to the setting of the storing money setting unit 73, and stored in the denomination-specific storing and ejecting units 211.

As a result of recognition by the recognition unit 209, abnormal coins not recognized as normal coins and coins other than stained coins are passed through the positions of the denomination-specific storing and ejecting units 211 of the coin path 216 and distributed to the escrow unit 212 by the gate member 225 of the escrow unit 212, and fed into and stored in the coin cassette 205 through the chute portion 235 which has been rotated to the ejecting position for ejection to the coin cassette 205 side.

Then, when storing of the escrowed coins to be deposited in the denomination-specific storing and ejecting units 211 or coin cassette 205 is completed, the depositing process is ended.

After the coins to be deposited are escrowed, when a return instruction is issued, the chute portion 235 of the escrow unit 212 is rotated from the escrow position to the ejecting position for ejection to the pooling and feeding unit 210, and coins escrowed in the chute portion 235 of the escrow unit 212 are fed into the pooling and feeding unit 210.

Thereafter, coins in the pooling and feeding unit 210 are fed out one by one to the coin path 216, and the coins fed out into the coin path 216 are transported one by one in the deposit transporting direction F1 by the transporting belt 217, ejected from the front end as the terminal end of the second path portion 220 of the coin path 216 to the dispensing escrow unit 213, and ejected to the outlet 204 through the chute portion 235 which has been rotated to the ejecting position for ejection to the outlet 204 and returned.

Next, a dispensing operation will be described.

When a dispensing instruction including the denomination and the number of coins to be dispensed or the amount of money to be dispensed is received, coins in the corresponding denomination-specific storing and ejecting unit 211 storing coins to be dispensed are fed out one by one to the coin path 216, and coins fed out into the coin path 216 are transported one by one in the dispensing transporting direction F2 by the transporting belt 217, and the coins transported inside the coin path 216 are recognized by the recognition unit 209. In this case, when coins are ejected from a plurality of denomination-specific storing and ejecting units 211, successive ejection is performed in such a manner that coins are ejected from any one of the denomination-specific storing and ejecting units 211, and after the ejection of coins corresponding to the amount to be dispensed from this denomination-specific storing and ejecting unit 211 is completed, coins corresponding to the amount to be dispensed are ejected from the next denomination-specific storing and ejecting unit 211.

As a result of recognition by the recognition unit 209, coins recognized as normal coins and stained coins among unfit coins are transported to the front end as a terminal end of the dispensing path portion 221 and ejected to the dispensing escrow unit 213, and pooled inside a chute portion 235 which has been rotated to the escrow position so that the lower opening 236 is closed by the closing member.

As a result of recognition by the recognition unit 209, abnormal coins not recognized as normal coins, unfit coins other than stained coins, and coins of a denomination unnecessary to be dispensed, fed out to the coin path 216 in a case where coins of a plurality of denominations are stored in a mixed state in the denomination-specific storing and ejecting units 211, are distributed to and stored in the pooling and feeding unit 210 by the gate member 225 of the pooling and feeding unit 210 from the coin path 216. Then, coins corresponding to the shortfall are additionally ejected from the corresponding denomination-specific storing and ejecting units 211.

Then, after coins corresponding to an amount to be dispensed are pooled in the chute portion 235 of the dispensing escrow unit 213, the chute portion 235 is rotated from the escrow position to the ejecting position for ejection to the outlet 204 to eject and dispense the coins pooled inside the chute portion 235 to the outlet 204.

Thereafter, when abnormal coins not recognized as normal coins and unfit coins other than stained coins are distributed to the pooling and feeding unit 210, coins in the pooling and feeding unit 210 are fed out one by one to the coin path 216, and the coins fed out to the coin path 216 are transported one by one in the deposit transporting direction F1 by the transporting belt 217, and the coins transported in the coin path 216 are recognized by the recognition unit 209.

As a result of recognition by the recognition unit 209, coins recognized as normal coins are distributed from the coin path 216 to the corresponding denomination-specific storing and ejecting units 211 by the gate members 225 of the denomination-specific storing and ejecting units 211 according to the setting of the storing money setting unit 73, and stored in the denomination-specific storing and ejecting units 211.

As a result of recognition by the recognition unit 209, abnormal coins not recognized as normal coins and unfit coins other than stained coins are passed through the positions of the denomination-specific storing and ejecting units 211 of the coin path 216 and distributed to the escrow unit 212 by the gate member 225 of the escrow unit 212, and fed into and stored in the coin cassette 205 through the chute portion 235 which has been rotated to the ejecting position for ejection to the coin cassette 205.

Thus, in a dispensing process, coins recognized as normal coins by the recognition unit 209 are transported to the outlet 204, and it is judged whether stained coins among coins recognized as unfit coins are allowed to be dispensed to the outlet 204 according to the kinds of the unfit coins, and unfit coins of a specific kind are not rejected but are handled as coins to be dispensed, and accordingly, reduction in coins recyclable as coins to be dispensed in the denomination-specific storing and ejecting units 211 is suppressed, and suspension of transactions due to a shortage of coins to be dispensed can be prevented.

In particular, among coins recognized as unfit coins by the recognition unit 209, for example, stained coins set as allowed to be dispensed according to the kind set by the dispensing unfit money kind setting unit 72 are transported to the outlet 204 and, for example, coins other than stained coins, set as disallowed to be dispensed, are transported to the coin cassette 205 via the pooling and feeding unit 210, and accordingly, only stained coins that are a set specific kind can be handled as coins to be dispensed without being rejected, and even when the coin depositing and dispensing machine 201 is used in, for example, a place in which unfit coins are highly frequently recognized, suspension of transactions due to a shortage of coins to be dispensed in the denomination-specific storing and ejecting units 211 can be prevented.

Further, by the storing money setting unit 73, any setting of storing unfit coins of all denominations and a plurality of normal coins in a mixed state, storing unfit coins of a specific denomination and a plurality of normal coins in a mixed state, storing only unfit coins of all denominations, and storing only unfit coins of only a specific denomination can be made for each of the plurality of denomination-specific storing and ejecting units 211, and accordingly, a large volume of unfit coins can be stored by using the denomination-specific storing and ejecting units 211.

INDUSTRIAL APPLICABILITY

The present invention is applicable to a money depositing and dispensing machine such as a banknote depositing and dispensing machine which handles banknotes as money, a coin depositing and dispensing machine which handles coins, and a banknote and coin depositing and dispensing machine which handles both of banknotes and coins.

The invention claimed is:

1. A money depositing and dispensing machine which performs money depositing and dispensing processes, comprising:

an inlet for receiving money to be deposited;

an outlet for ejecting money to be dispensed;

a recognition unit which recognizes a denomination and fitness of money and a kind of unfit money;

a plurality of denomination-specific storing and ejecting units which store money by denomination according to a result of recognition by the recognition unit and are capable of ejecting stored money to be transported to the outlet in a dispensing process; and a control unit which transports money recognized as normal money by the recognition unit to the outlet, and judges whether money recognized as regular but unfit money is allowed to be dispensed to the outlet in a dispensing process, based on the kind of unfit money.

2. The money depositing and dispensing machine according to claim 1, comprising: a dispensing unfit money kind setting unit capable of setting a kind of unfit money which is allowed to be dispensed to the outlet.

3. The money depositing and dispensing machine according to claim 2, comprising:

a rejected money storing unit which stores money not recognized as normal money by the recognition unit, wherein in a dispensing process, among money recognized as unfit money by the recognition unit, according to the kind set by the dispensing unfit money kind setting unit, the control unit determines to transport money set as allowed to be dispensed to the outlet, and determines to transport money set as disallowed to be dispensed, to the rejected money storing unit.

4. The money depositing and dispensing machine according to claim 3, comprising:

an escrow unit which escrows money to be deposited, wherein in a depositing process, the control unit transports normal money to the escrow unit, and after a deposit is approved, re-recognizes the money in the escrow unit, and determines to transport unfit money judged as disallowed to be dispensed to the outlet according to a re-recognition result and the kind set by the dispensing unfit money kind setting unit, to the rejected money storing unit.

5. The money depositing and dispensing machine according to claim 2, comprising:

a rejected money storing unit which stores money not recognized as normal money by the recognition unit, wherein in a dispensing process, among money recognized as unfit money by the recognition unit, according to the kind set by the depositing unfit money kind setting unit, the control unit determines to transport stained money to the outlet, and determines to transport unfit money other than stained money to the rejected money storing unit.

6. The money depositing and dispensing machine according to claim 5, wherein the kind of unfit money to be recognized by the recognition unit includes, in addition to the stained money, at least any one kind of thickened money with a thickness different from that of normal money, deformed money with a size different from that of normal money, and fatigued money with a higher degree of fatigue than normal money.

7. The money depositing and dispensing machine according to claim 2, comprising:

a storing money setting unit capable of setting to store unfit money of a specific denomination and one or more pieces of normal money in a mixed state for each of the plurality of denomination-specific storing and ejecting units.

8. The money depositing and dispensing machine according to claim 2, comprising:

a storing money setting unit capable of setting to store only unfit money of only a specific denomination for each of the plurality of denomination-specific storing and ejecting units.

9. The money depositing and dispensing machine according to claim 1, comprising: a plurality of recognition units.

10. The money depositing and dispensing machine according to claim 1, comprising:

a storing money setting unit capable of setting to store unfit money of all denominations and one or more pieces of normal money in a mixed state for each of the plurality of denomination-specific storing and ejecting units.

11. The money depositing and dispensing machine according to claim 10, comprising:

an escrow unit which escrows money to be deposited, wherein in a depositing process, the control unit transports normal money to the escrow unit, and after a deposit is approved, re-recognizes the money in the escrow unit, and determines to transport unfit money judged as allowed to be dispensed to the outlet according to a re-recognition result and the kind set by the dispensing unfit money kind setting unit, to the corresponding denomination-specific storing and ejecting unit based on information set by the storing money setting unit.

12. The money depositing and dispensing machine according to claim 10, comprising:

an escrow unit which escrows money to be deposited; and a rejected money storing unit which stores money not recognized as normal money by the recognition unit, wherein in a depositing process, the control unit transports normal money to the escrow unit, and after a deposit is approved, re-recognizes the money in the escrow unit, and determines to transport unfit money judged as disallowed to be dispensed to the outlet according to a re-recognition result and the kind set by the dispensing unfit money kind setting unit, to the rejected money storing unit, and determines to transport unfit money judged as allowed to be dispensed to the outlet to the corresponding denomination-specific storing and ejecting unit based on information set by the storing money setting unit.

13. The money depositing and dispensing machine according to claim 10, comprising:

an escrow unit which escrows money to be deposited, wherein in a dispensing process, when money is dispensed from the denomination-specific storing and ejecting unit storing one or more pieces of normal money and unfit money in a mixed state based on the storing money setting unit, in a case where money of a denomination unnecessary to be dispensed is ejected from the denomination-specific storing and ejecting unit, the control unit transports the money of the denomination unnecessary to be dispensed, to the escrow unit, and after a predetermined quantity of money is ejected to the outlet, transports the money of the denomination unnecessary to be dispensed which has been transported to the escrow unit, to the corresponding denomination-specific storing and ejecting unit.

14. The money depositing and dispensing machine according to claim 1, comprising:

a storing money setting unit capable of setting to store only unfit money of all denominations for each of the plurality of denomination-specific storing and ejecting units.

* * * * *